US010513408B2

(12) United States Patent
Nakamura et al.

(10) Patent No.: US 10,513,408 B2
(45) Date of Patent: Dec. 24, 2019

(54) SHEET CONVEYING DEVICE AND IMAGE FORMING APPARATUS INCORPORATING THE SHEET CONVEYING DEVICE

(71) Applicants: Shogo Nakamura, Kanagawa (JP); Takehiro Fujita, Kanagawa (JP); Tomoki Shimohira, Saitama (JP)

(72) Inventors: Shogo Nakamura, Kanagawa (JP); Takehiro Fujita, Kanagawa (JP); Tomoki Shimohira, Saitama (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/001,009

(22) Filed: Jun. 6, 2018

(65) Prior Publication Data

US 2018/0346271 A1 Dec. 6, 2018

(30) Foreign Application Priority Data

Jun. 6, 2017 (JP) ..... 2017-111992
Apr. 27, 2018 (JP) ..... 2018-086718

(51) Int. Cl.
*B65H 9/00* (2006.01)
*B65H 7/14* (2006.01)
(Continued)

(52) U.S. Cl.
CPC ..... *B65H 9/002* (2013.01); *B65H 5/062* (2013.01); *B65H 7/08* (2013.01); *B65H 7/10* (2013.01);
(Continued)

(58) Field of Classification Search
CPC ..... B65H 9/106; B65H 9/12; B65H 9/18; B65H 9/20; B65H 9/002
See application file for complete search history.

(56) References Cited

U.S. PATENT DOCUMENTS 9,248,979 B2 * 2/2016 Sako ..... B65G 47/24
2006/0232759 A1 10/2006 Fukube et al.
(Continued)

FOREIGN PATENT DOCUMENTS

JP 6-234441 8/1994
JP 9-175694 7/1997
(Continued)

OTHER PUBLICATIONS

Extended European Search Report dated Nov. 13, 2018.

*Primary Examiner* — Thomas A Morrison
(74) *Attorney, Agent, or Firm* — Harness, Dickey & Pierce, P.L.C.

(57) ABSTRACT

A sheet conveying device, which is included in an image forming apparatus, includes a pair of rollers configured to convey a sheet in a sheet conveyance passage, a detector configured to optically detect an attitude of the sheet, one of a rotation device to rotate the pair of rollers in a direction parallel to a plane of the sheet and a moving device to move the pair of rollers in a width direction, and a controller configured to correct the attitude of the pair of rollers at a time interval, based on a detection result obtained by the detector. The controller performs the correcting operation by setting, according to reflectance of the sheet, at least one of a light emission time of the detector, the time interval of the correcting operation, light emission intensity of the detector and a conveying speed of the sheet.

18 Claims, 23 Drawing Sheets

(51) Int. Cl.

| | |
|---|---|
| ***B65H 5/06*** | (2006.01) |
| ***B65H 7/08*** | (2006.01) |
| ***B65H 7/10*** | (2006.01) |
| ***B65H 9/20*** | (2006.01) |

(52) U.S. Cl.

CPC ..... *B65H 7/14* (2013.01); *B65H 9/20* (2013.01); *B65H 2404/1424* (2013.01); *B65H 2404/14212* (2013.01); *B65H 2511/411* (2013.01); *B65H 2511/414* (2013.01); *B65H 2515/60* (2013.01)

(56) References Cited

U.S. PATENT DOCUMENTS

| | | | | |
|---|---|---|---|---|
| 2007/0297821 | A1 | 12/2007 | Yamauchi et al. | |
| 2013/0277909 | A1 | 10/2013 | Ino | |
| 2016/0159598 | A1 | 6/2016 | Yamane et al. | |
| 2016/0167408 | A1* | 6/2016 | Sasaki ..... | B41J 11/0095 347/16 |

FOREIGN PATENT DOCUMENTS

| | | |
|---|---|---|
| JP | 10-067448 | 3/1998 |
| JP | 10-120253 | 5/1998 |
| JP | 2005-041603 | 2/2005 |
| JP | 2005-041604 | 2/2005 |
| JP | 2005-053646 | 3/2005 |
| JP | 2005-178929 | 7/2005 |
| JP | 2006-027859 | 2/2006 |
| JP | 2007-022806 | 2/2007 |
| JP | 2011-098790 | 5/2011 |
| JP | 2014-088263 | 5/2014 |
| JP | 2014-193769 | 10/2014 |
| JP | 2016-024546 | 2/2016 |
| JP | 2016-044067 | 4/2016 |
| JP | 2016-108152 | 6/2016 |
| JP | 2016-175776 | 10/2016 |
| JP | 2016-188142 | 11/2016 |
| JP | 2017-202916 | 11/2017 |

* cited by examiner

SHEET CONVEYING DEVICE AND IMAGE FORMING APPARATUS INCORPORATING THE SHEET CONVEYING DEVICE

CROSS-REFERENCE TO RELATED APPLICATIONS

This patent application is based on and claims priority pursuant to 35 U.S.C. § 119(a) to Japanese Patent Application Nos. 2017-111992, filed on Jun. 6, 2017, and 2018-086718, filed on Apr. 27, 2018, in the Japan Patent Office, the entire disclosure of each of which is hereby incorporated by reference herein.

BACKGROUND

Technical Field

This disclosure relates to a sheet conveying device that conveys a sheet, and an image forming apparatus such as a copier, printer, facsimile machine, a multi-functional apparatus including at least two functions of the copier, printer, and facsimile machine, and an offset printing machine.

Related Art

Known image forming apparatuses such as copiers and printers employ a sheet conveying device having a detector. As an example of the detector, the known sheet conveying device includes multiple CISs disposed at intervals in a sheet conveying direction along a sheet conveyance passage. Based on detection results of the multiple CISs, an angular displacement (skew) of a sheet (i.e., a positional deviation of a sheet in a radial or rotational direction) is corrected, and a lateral displacement of the sheet (i.e., a positional deviation of a sheet in a width direction that is a direction perpendicular to the sheet conveying direction) corrected to a normal position.

Specifically, a known image forming apparatus includes a pair of sheet holding rollers to rotate in the rotational direction or move in the width direction while holding and conveying a sheet. In addition, two CISs (a first detector) are disposed upstream from the pair of sheet holding rollers in the sheet conveying direction and aligned along the sheet conveyance passage and one CIS (a second detector) is disposed downstream from the pair of sheet holding rollers in the sheet conveying direction. These CISs are to detect an attitude of the sheet in the rotational direction and the width direction when the sheet is passing the respective positions of the CISs.

Then, while holding and conveying the sheet, the pair of sheet holding rollers 31 rotates in the rotational direction of the sheet to correct the angular displacement (skew) and moves in the width direction of the sheet to correct the lateral displacement based on the detection results detected by the two upstream side CISs. Thereafter, while holding and conveying the sheet after corrections of the angular displacement and the lateral displacement, the pair of sheet holding rollers further rotates in the rotational direction of the sheet to correct the angular displacement and moves in the width direction of the sheet to correct the lateral displacement based on the detection results detected by the two upstream side CISs disposed upstream from the pair of sheet holding rollers and the downstream side CIS disposed downstream from the pair of sheet holding rollers in the sheet conveying direction.

After having corrected the attitude of the sheet in the rotational direction and the width direction once while the pair of sheet holding rollers was holding and conveying the sheet, the above-described known sheet conveying device corrects for the second time (i.e., performs a recorrecting operation or a correcting operation of the angular and lateral displacements again). Therefore, the higher accurate correcting operation of the attitude of the sheet is greatly expected.

However, it is likely that the above-described known sheet conveying device cannot correct the attitude of the sheet with high accuracy when various sheets having different reflectance due to different colors are conveyed.

SUMMARY

At least one aspect of this disclosure provides a sheet conveying device including a pair of rollers, a detector, a rotation device, and a controller. The pair of rollers is configured to convey a sheet in a sheet conveyance passage. The detector is configured to detect an attitude of the sheet optically in the sheet conveyance passage. The rotation device is configured to rotate the pair of rollers in a direction parallel to a plane of the sheet. The controller is configured to perform a correcting operation to correct the attitude of the pair of rollers at a time interval, while the pair of rollers is holding the sheet, by driving the rotation device based on a detection result obtained by the detector. The controller performs the correcting operation by setting, according to reflectance of the sheet, at least one of a light emission time of the detector, the time interval to perform the correcting operation, light emission intensity of the detector and a conveying speed of the sheet by the pair of rollers.

Further, at least one aspect of this disclosure provides an image forming apparatus including the above-described sheet conveying device.

Further, at least one aspect of this disclosure provides a sheet conveying device including a pair of rollers, a detector, a moving device, and a controller. The pair of rollers is configured to convey a sheet in a sheet conveyance passage. The detector is configured to detect an attitude of the sheet optically in the sheet conveyance passage. The moving device is configured to move the pair of rollers in a width direction. The controller is configured to perform a correcting operation to correct the attitude of the pair of rollers at an interval, while the pair of rollers is holding the sheet, by driving the moving device based on a detection result obtained by the detector. The controller performs the correcting operation by setting, according to reflectance of the sheet, at least one of a light emission time of the detector, the time interval to perform the correcting operation, light emission intensity of the detector and a conveying speed of the sheet by the pair of rollers.

Further, at least one aspect of this disclosure provides an image forming apparatus including the above-described sheet conveying device.

BRIEF DESCRIPTION OF THE SEVERAL VIEWS OF THE DRAWINGS

An exemplary embodiment of this disclosure will be described in detail based on the following figured, wherein.

Figure 1:
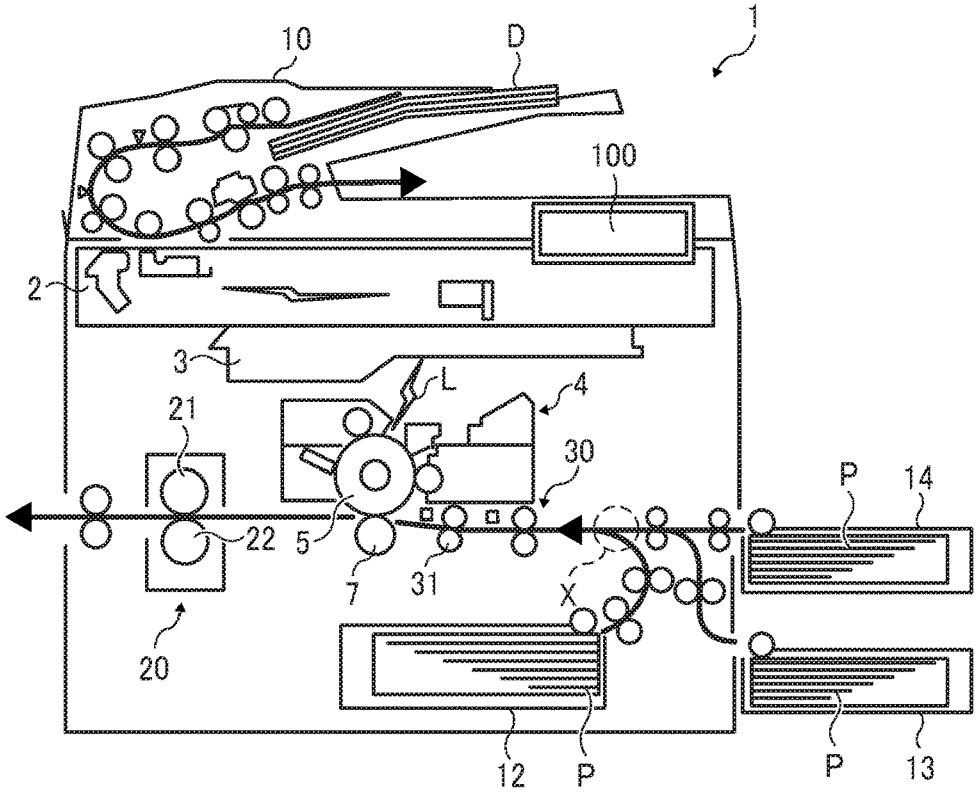
FIG. 1 is a diagram illustrating an overall configuration of an image forming apparatus according to Embodiment 1 of this disclosure.

The accompanying drawings are intended to depict embodiments of this disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Next, a description is given of a configuration and functions of an image forming apparatus according to an embodiment of this disclosure, with reference to drawings. It is to be noted that identical elements (for example, mechanical parts and components) are provided identical reference numerals and redundant descriptions are summarized or omitted accordingly.

Embodiment 1

Now, a description is given of an overall configuration and operations of an image forming apparatus 1 according to an embodiment of this disclosure, with reference to FIG. 1. FIG. 1 is a diagram illustrating a schematic configuration of the image forming apparatus 1 according to Embodiment 1 of this disclosure.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

In FIG. 1, the image forming apparatus 1 includes a document reading device 2, an exposure device 3, an image forming device 4, a photoconductor drum 5, a transfer roller 7, a document conveying unit 10, a first sheet feeding unit 12, a second sheet feeding unit 13, a third sheet feeding unit 14, a fixing device 20, a fixing roller 21, a pressure roller 22, a sheet conveying device 30, and a pair of sheet holding rollers 31.

The document reading device 2 optically reads image data of an original document D.

The exposure device 3 emits an exposure light L based on the image data read by the document reading device 2 to irradiate the exposure light L onto a surface of the photoconductor drum 5 that functions as an image bearer.

The image forming device 4 forms a toner image on the surface of the photoconductor drum 5.

The transfer roller 7 functions as a transfer unit to transfer the toner image formed on the surface of the photoconductor drum 5 onto a sheet P.

The photoconductor drum 5 that functions as an image bearer and the transfer roller 7 that functions as a transfer unit are included in the image forming device 4.

The document conveying unit 10 conveys the original document D set on a document tray or loader to the document reading device 2.

The first sheet feeding unit 12, the second sheet feeding unit 13, and the third sheet feeding unit 14 are sheet trays, each of which contains the sheet P (a recording medium P) therein.

The fixing device 20 includes the fixing roller 21 and the pressure roller 22 to fix an unfixed image formed on the sheet P to the sheet P by application of heat by the fixing roller 21 and pressure by the pressure roller 22.

The sheet conveying device 30 conveys the sheet through a sheet conveyance passage.

The pair of sheet holding rollers 31 functions as a pair of rotary bodies (e.g., a pair of registration rollers and a pair of timing rollers) to convey the sheet P to the transfer roller 7. The pair of sheet holding rollers 31 is also referred to as a pair of angular and lateral displacement correction rollers.

Now, a description is given of regular image forming operations performed by the image forming apparatus 1, with reference to FIG. 1.

The original document D is fed from a document loading table provided to the document conveying unit 10 and conveyed by multiple pairs of sheet conveying rollers disposed in the document conveying unit 10 in a direction indicated by arrow in FIG. 1 over the document reading device 2. At this time, the document reading device 2 optically reads image data of the original document D passing over the document reading device 2.

Consequently, the image data optically scanned by the document reading device 2 is converted to electrical signals. The converted electrical signals are transmitted to the exposure device 3 (a writing portion) by which the image is optically written. Then, the exposure device 3 emits the exposure light (laser light) L based on the image data of the electrical signals toward the surface of the photoconductor drum 5 of the image forming device 4.

By contrast, the photoconductor drum 5 of the image forming device 4 rotates in a clockwise direction in FIG. 1. After a series of predetermined image forming processes, e.g., a charging process, an exposing process, and a developing process is completed, a toner image corresponding to the image data is formed on the surface of the photoconductor drum 5.

Then, the toner image formed on the surface of the photoconductor drum 5 is transferred onto the sheet P that has been conveyed by the pair of sheet holding rollers 31 a of rotary bodies or rollers) that functions as a pair of registration rollers, at a transfer nip region of the transfer roller 7 where the photoconductor drum 5 and the transfer roller 7 contact to each other.

By contrast, referring to FIGS. 1 and 2, the sheet P to be conveyed to the transfer roller 7 (the transfer nip region) is operated as follows.

Figure 2:
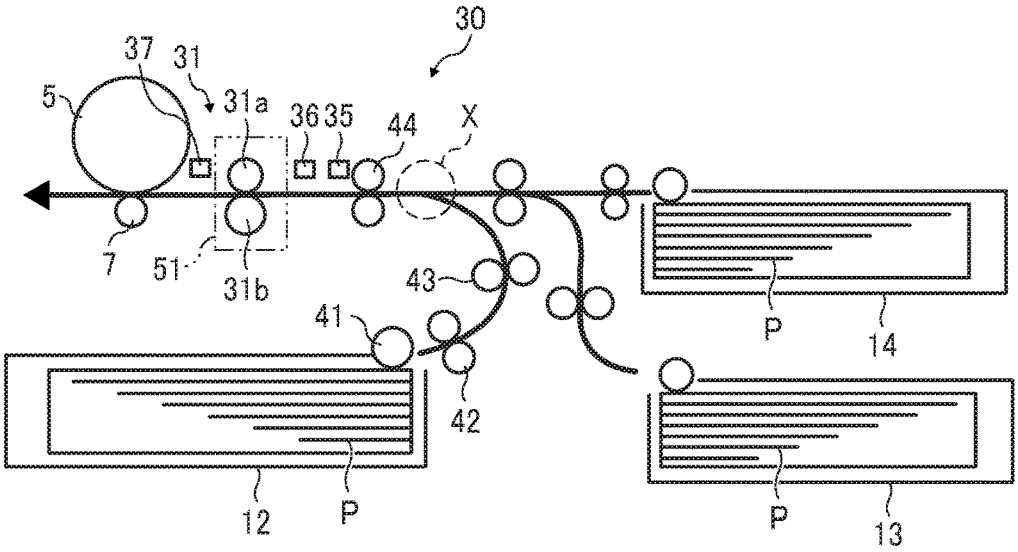
FIG. 2 is a schematic diagram illustrating a sheet conveying device included in the image forming apparatus of FIG. 1.

First, as illustrated in FIGS. 1 and 2, one of the first sheet feeding unit 12, the second sheet feeding unit 13 and the third sheet feeding unit 14 of the image forming apparatus 1 is selected automatically or manually. It is to be noted that the first sheet feeding unit 12, the second sheet feeding unit 13 and the third sheet feeding unit 14 basically have an identical configuration to each other, except the second sheet feeding unit 13 and the third sheet feeding unit 14 disposed outside an apparatus body of the image forming apparatus 1. The following description is given of an operation in a case when the first sheet feeding unit 12 disposed inside the apparatus body of the image forming apparatus 1 is selected.

Consequently, when the first sheet feeding unit 12 of the image forming apparatus 1 is selected, an uppermost sheet P contained in the first sheet feeding unit 12 is fed by a sheet feed roller 41 toward a curved sheet conveyance passage having a first pair of sheet conveying rollers 42 and a second pair of sheet conveying rollers 43.

The sheet P travels in the curved sheet conveying passage toward a merging point X where the sheet conveying passage of the sheet fed from the first sheet feeding unit 12 and respective sheet conveying passages of the sheet P fed from the second sheet feeding unit 13 and the third sheet feeding unit 14 disposed outside an apparatus body of the image forming apparatus 1 merge. After passing the merging point X, the sheet P passes a straight sheet conveying passage in which a third pair of sheet conveying rollers 44 (i.e., a pair of upstream side sheet conveying rollers) and a alignment unit 51 are disposed, and reaches the alignment unit 51. Then, the pair of sheet holding rollers 31, which is provided to the alignment unit 51, performs the correction of angular displacement of the sheet P and the correction of lateral displacement of the sheet P. The sheet P is then conveyed toward the transfer roller 7 (i.e., the transfer nip region where the transfer roller 7 and the photoconductor drum 5 contact to each other) in synchronization with movement of the toner image formed on the surface of the photoconductor drum 5 for positioning.

It is to be noted that the transfer roller 7 and the photoconductor drum 5 rotate along the sheet conveying direction indicated by arrow in FIG. 1. Both the transfer roller 7 and the photoconductor drum 5 are disposed downstream from the pair of sheet holding rollers 31 in the sheet conveying direction, so as to also function as a pair of downstream side sheet conveying rollers to hold and convey the sheet P.

After completion of the transferring process, the sheet P passes the location of the transfer roller 7 (the transfer nip region), and then reaches the fixing device 20 via the sheet conveyance passage. In the fixing device 20, the sheet P is inserted to a fixing nip region between the fixing roller 21 and the pressure roller 22, so that the toner image is fixed to the sheet P by application of heat applied by the fixing roller 21 and pressure applied by the fixing roller 21 and the pressure roller 22. After having been discharged from the fixing nip region of the fixing device 20 (i.e., the fixing nip region formed between the fixing roller 21 and the pressure roller 22), the sheet P having the toner image fixed thereto is ejected from an apparatus body of the image forming apparatus 1 onto a sheet ejection tray.

Accordingly, a series of image forming processes (image forming operations) is completed.

As illustrated in FIG. 2, the image forming apparatus 1 according to Embodiment 1 of this disclosure feeds a sheet P from any selected one of the first sheet feeding unit 12, the second sheet feeding unit 13, and the third sheet feeding unit 14 toward the transfer roller 7 (i.e., the transfer nip region).

Further, each of multiple pairs of conveying rollers including the first pair of sheet conveying rollers 42, the second pair of sheet conveying rollers 43, the third pair of sheet conveying rollers 44 provided to the sheet conveying device 30 (including other pairs of sheet conveying rollers without reference numerals) includes a drive roller and a driven roller as a pair. The drive roller is driven and rotated by a driving mechanism and a driven roller is rotated with the drive roller by a frictional resistance with the drive roller. According to this configuration, the sheet P is conveyed while being held between these two rollers. The transfer roller 7 contacts the photoconductor drum 5 in the transfer nip region with a predetermined transfer bias applied thereto, rotates in a counterclockwise direction in FIG. 1, and the toner image borne on the surface of the photoconductor drum 5 is transferred onto the surface of the sheet P while conveying the sheet P held between the photoconductor drum 5 and the transfer roller 7.

As described above, the image forming apparatus 1 includes a straight sheet conveyance passage extending substantially linearly along the sheet conveying direction of sheet P. The straight sheet conveyance passage is a sheet conveyance passage from the merging point X, where a branched sheet conveyance passage from the first sheet feeding unit 12 and the other branched sheet conveyance passages from the second sheet feeding unit 13 and the third sheet feeding unit 14 merge, to the transfer roller 7 (i.e., the transfer nip region). The straight sheet conveying passage is defined by straight conveying guide plates that hold both sides (i.e., the front side and the back side) of the sheet P therebetween while the sheet P is being conveyed. The first upstream side CIS 35, the second upstream side CIS 36 and the downstream side CIS 37 are position detectors to detect the sheet P at respective positions are disposed along the sheet conveying direction. Specifically, the third pair of sheet conveying rollers 44 (i.e., the pair of upstream side sheet conveying rollers), the first upstream side CIS 35, the second upstream side CIS 36, the pair of sheet holding rollers 31 (i.e., the alignment unit 51) and the downstream side CIS 37 are disposed in this order to a downstream side in the sheet conveying direction. Both the third pair of sheet conveying rollers 44 and the pair of sheet holding rollers 31 are pair rollers, each pair including a drive roller and a driven roller. The drive roller and the driven roller of each of the third pair of sheet conveying rollers 44 and the pair of sheet holding rollers 31 convey the sheet P while holding the sheet P in a nip region formed therebetween. The pair of sheet holding rollers 31 is included in and also acts as the alignment unit 51 to align positional deviation, that is, to perform the correction of angular displacement of the sheet P (i.e., the correction of a positional deviation of the sheet P in the angular direction of the pair of sheet holding rollers 31 in the sheet conveying direction) and the correction of lateral displacement of the sheet P (i.e., the correction of a positional deviation of the sheet P in the width direction). Details of the operations of the pair of sheet holding rollers 31 will be described below.

Next, a detailed description is given of the sheet conveying device 30 according to Embodiment 1 of this disclosure, with reference to FIGS. 2 through 9F.

Specifically, a configuration, functions, and operations of the sheet conveying device 30 from the merging point X to the transfer roller 7 (i.e., in the transfer nip region) are described.

Figure 3:
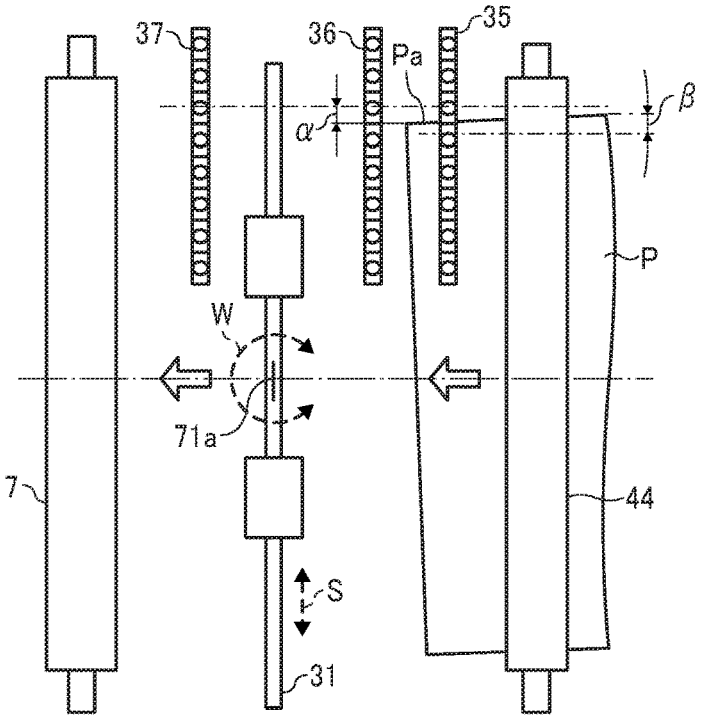
FIG. 3 is a top view illustrating the sheet conveying device.

As illustrated in FIGS. 2 and 3, the sheet conveying device 30 includes a third pair of sheet conveying rollers 44 that functions as a pair of upstream side sheet conveying rollers, two CISs (i.e., the first upstream side CIS 35 and the second upstream side CIS 36) that function as a first detector, the pair of sheet holding rollers 31 that functions as the alignment unit 51 and a pair of registration rollers, and the downstream side CIS 37 that functions as a second detector, along the straight sheet conveyance passage (extending from the merging point X to the transfer roller 7) of the sheet P.

The first upstream side CIS 35 that functions as a first detector, the second upstream side CIS 36 that also functions as a first detector and the downstream side CIS 37 that functions as a second detector are contact image sensors aligned in the width direction (i.e., a direction perpendicular to a drawing sheet of FIG. 2 and a vertical direction of FIG. 3) of the sheet P. Each contact image sensor (CIS) includes multiple photosensors to optically detect a side end Pa (an edge portion) of the sheet P that is passing the position where the CIS is disposed.

As described above, the sheet conveying device 30 according to Embodiment 1 of this disclosure includes multiple CISs (i.e., the first upstream side CIS 35, the second upstream side CIS 36 and the downstream side CIS 37) are disposed at intervals in the predetermined sheet conveying direction so as to detect the side end Pa of the sheet P that is being conveyed in the predetermined sheet conveying direction through the sheet conveyance passage.

Here, the pair of sheet holding rollers 31 that functions as a pair of rollers is driven and rotated by a first drive motor 59 that functions as a first drive device to convey the sheet P while the pair of sheet holding rollers 31 is holding the sheet P at the nip region thereof. The pair of sheet holding rollers 31 (a pair of rollers) is also rotated by a rotation device that functions as a second drive device in a direction parallel to a plane of the sheet P. At the same time, the pair of sheet holding rollers 31 is moved by a shift device that functions as a third drive device in the width direction of the sheet P. Hereinafter, the direction parallel to a plane of the sheet P is occasionally referred to as an "angular direction."

The pair of sheet holding rollers 31 includes multiple roller pairs that are divided in the width direction of the sheet P. In this specification, the multiple roller pairs of the pair of sheet holding rollers 31 are simply referred to in a singular form as a "pair of sheet holding rollers" or a "pair of sheet holding rollers 31" collectively. Specifically, the pair of sheet holding rollers 31 includes a drive roller 31*a* and a driven roller 31*b*. The drive roller 31*a* is driven to rotate by the first drive motor 59 (see FIG. 4) that functions as a drive device (a first drive device). The driven roller 31*b* is rotated along with rotation of the drive roller 31*a*. The pair of sheet holding rollers 31 conveys the sheet P by rotating while holding the sheet P between the drive roller 31*a* and the driven roller 31*b*.

It is to be noted that, the pair of sheet holding rollers 31 in Embodiment 1 has multiple pairs of rollers divided in the width direction thereof. However, the structure of a pair of sheet holding rollers is not limited thereto. For example, a pair of sheet holding rollers that is not divided in the width direction but extends over the whole width thereof can be applied to this disclosure.

In addition, the pair of sheet holding rollers 31 (the pair of rollers) is formed to rotate in the angular direction of the sheet P (i.e., the direction indicated by a dotted bidirectional arrow W in FIG. 3 and in a direction parallel to a plane of the sheet) and to move in the width direction of the sheet P (i.e., a direction indicated by a dotted bidirectional arrow S in FIG. 3).

Figure 4:
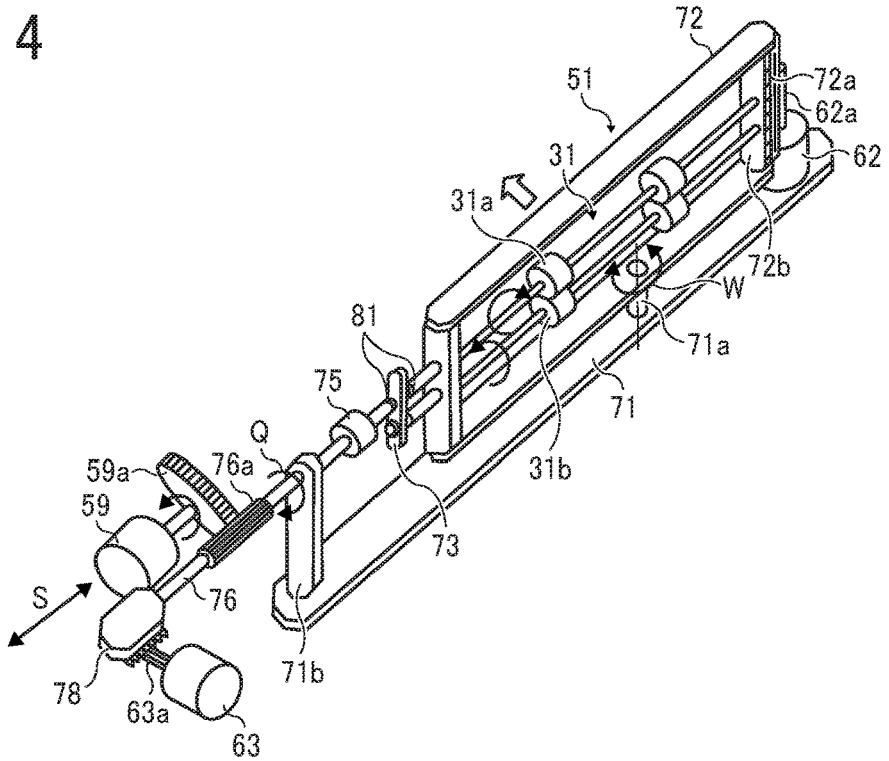
FIG. 4 is a perspective view illustrating a main part of the sheet conveying device.

More specifically, as illustrated in FIG. 4, the pair of sheet holding rollers 31 having the drive roller 31*a* and the driven roller 31*b* is driven to rotate by the first drive motor 59 that functions as a drive device (the first drive device), so as to convey the sheet P while holding the sheet P therebetween.

To be more specific, the first drive motor 59 (the first drive device) is fixedly mounted on a frame of the sheet conveying device 30 (of the image forming apparatus 1). The first drive motor 59 includes a motor shaft and a drive gear 59*a* that is mounted on the motor shaft. The drive gear 59*a* meshes with a gear 76*a* of a frame side rotary shaft 76. The gear 76*a* of the frame side rotary shaft 76 (which is formed to have a sufficiently long tooth width in the width direction) is rotationally supported to an uprising portion 71*b* of a base 71 (the frame). The drive gear 59*a* of the first drive motor 59 is meshed with the uprising portion 71*b* of the base 71 to rotate the frame side rotary shaft 76 in a direction indicated by arrow Q in FIG. 4. As the frame side rotary shaft 76 is driven and rotated, a rotational driving force applied by the rotation of the frame side rotary shaft 76 is transmitted to a rotary shaft of the drive roller 31*a* of the pair of sheet holding rollers 31 via a coupling 75. This transmission rotates the rotary shaft of the drive roller 31*a*. Accordingly, the driven roller 31*b* is rotated with the drive roller 31*a*.

The coupling 75 is disposed between the rotary shaft of the drive roller 31*a* and the frame side rotary shaft 76 rotationally supported by the base 71 of the frame of the sheet conveying device 30. The coupling 75 is a shaft coupling such as a constant velocity (universal) joint and a universal joint. With the coupling 75, when a second drive motor 62 is driven, the pair of sheet holding rollers 31 rotates together with a holding member 72. With this configuration, even if a shaft angle of the rotary shaft of the drive roller 31*a* and the frame side rotary shaft 76 is changed, a speed of rotation does not change, and therefore the rotational driving force is transmitted without causing any change of the speed of rotation.

The holding member 72 (a movable member) is a movable body having a substantially rectangular shape. The pair of sheet holding rollers 31 is rotationally supported by the holding member 72 and is movably supported in the width direction thereof. Specifically, both lateral ends of the rotary shaft of each of the drive roller 31*a* and the driven roller 31*b* of the pair of sheet holding rollers 31 are rotationally supported to the holding member 72 via respective bearings that are fixedly mounted on the holding member 72. Further, the drive roller 31*a* and the driven roller 31*b* are supported by the holding member 72 to be movable in the width direction (an extending direction of the rotary shafts) of the drive roller 31*a* and the driven roller 31*b*. Specifically, a sufficient gap is provided between a supporting part 72*b* disposed at one end of the holding member 72 and a gear 72*a*, even if the drive roller 31*a* and the driven roller 31*b* slide to the one end in the width direction, the respective rotary shafts of the drive roller 31*a* and the driven roller 31*b* do not interfere with the gear 72*a*.

Further, the holding member 72 is rotationally supported about the shaft 71*a* to the base 71 that functions as part of the frame of the sheet conveying device 30 (of the image forming apparatus 1). Further, the second drive motor 62 (a rotation motor) that functions as a rotation device (a second drive device) is fixedly mounted on one end in the width direction of the base 71. The second drive motor 62 has a motor shaft 62*a* on which a gear is mounted. The gear mounted on the motor shaft 62*a* meshes with the gear 72*a* that is disposed at one end in the width direction of the holding member 72. With this structure, as the second drive motor 62 drives to rotate in a forward direction or in a backward direction, the pair of sheet holding rollers 31 rotates about the shaft 71*a* in the direction W, together with the holding member 72 as illustrated in FIGS. 3 and 4. The second drive motor 62 that functions as a rotation device is driven to rotate the holding member 72 to the angular direction, together with the pair of sheet holding rollers 31 based on results detected by the respective CISs, which are the first upstream side CIS 35, the second upstream side CIS 36 and the downstream side CIS 37. It is to be noted that a known encoder is mounted on the motor shaft of the second drive motor 62 (the rotation motor), so that the rotation degree and the angular direction of the pair of sheet holding rollers 31 to the home position of the pair of sheet holding rollers 31 are detected indirectly.

Accordingly, the pair of sheet holding rollers 31 can perform the angular displacement correction based on the detection results detected by the first upstream side CIS 35, the second upstream side CIS 36 and the downstream side CIS 37. As described above, the parts of the sheet conveying device 30, such as the second drive motor 62 and the holding member 72, function as a rotation device (a rotation mechanism) to rotate the pair of sheet holding rollers 31 that functions as a pair of rollers in the direction parallel to a plane of the sheet P (in the angular direction to rotate relative to the sheet conveying direction.

It is to be noted that the pair of sheet holding rollers 31 (the holding member 72) according to Embodiment 1 rotates about the center of the pair of sheet holding rollers 31 in the width direction. However, the configuration of the pair of sheet holding rollers 31 is not limited thereto. For example, the pair of sheet holding rollers 31 (the holding member 72) may rotate about an end of the pair of sheet holding rollers 31 in the width direction.

A rack gear 78 is disposed at the other end in the width direction of the frame side rotary shaft 76 that is rotatably supported by the base 71 (i.e., the frame) and meshes with a pinion gear that is mounted on a motor shaft 63*a* of a third drive motor 63 (a shift motor) that functions as a moving device (a third drive device). The rack gear 78 that is supported by the frame, so as to slide together with the frame side rotary shaft 76 in the width direction (i.e., the direction S illustrated in FIG. 4) without rotating, along a guide rail that is formed on the frame of the sheet conveying device 30. Similar to the first drive motor 59 and the second drive motor 62, the third drive motor 63 that functions as a moving device is fixed to the frame of the sheet conveying device 30 (the image forming apparatus 1).

By contrast, a connecting member 73 is disposed between the coupling 75 and a supporting part disposed at the other end of the holding member 72. The connecting member 73 rotatable connects the drive roller 31*a* and the driven roller 31*b* so that the drive roller 31*a* and the driven roller 31*b* move together with each other in the width direction S. Specifically, the connecting member 73 is held by retaining rings 81 disposed at respective gutters formed on the rotary shaft of the drive roller 31*a* and the rotary shaft of the driven roller 31*b*. As the drive roller 31*a* moves in the width direction, the driven roller 31*b* is moved together with the drive roller 31*a* in the width direction by the same distance as the drive roller 31*a*.

With this configuration, the pair of sheet holding rollers 31 moves in the width direction (i.e., the direction S in FIG. 4, the vertical direction to the drawing sheet of FIG. 2 and the vertical direction of FIG. 3) along with rotation of the third drive motor 63 in the forward and backward directions. The third drive motor 63 that functions as a moving device is formed to rotate the pair of sheet holding rollers 31 with the frame side rotary shaft 76 in the width direction, based on the detection results of the first upstream side CIS 35, the second upstream side CIS 36 and the downstream side CIS 37.

It is to be noted that a known encoder is mounted on the motor shaft of the third drive motor 63 (i.e., a shift motor), so that the rotation degree and the angular direction of the pair of sheet holding rollers 31 in the width direction with respect to the home position of the pair of sheet holding rollers 31 are detected indirectly. Accordingly, the pair of sheet holding rollers 31 can perform the lateral displacement correction based on the detection results detected by the first upstream side CIS 35, the second upstream side CIS 36 and the downstream side CIS 37.

The parts such as the third drive motor 63, the rack gear 78, the frame side rotary shaft 76, the coupling 75, the connecting member 73 and the holding member 72 function as a moving device (a moving mechanism) to move the pair of sheet holding rollers 31 in the width direction.

Then, while holding and conveying the sheet P, the pair of sheet holding rollers 31 rotates in the angular direction together with the holding member 72, based on the detection results of two of the three CISs, which are the first upstream side CIS 35, the second upstream side CIS 36 and the downstream side CIS 37. By so doing, the pair of sheet holding rollers 31 corrects the angular displacement amount for multiple times. That is, the pair of sheet holding rollers 31 functions as a member to perform a skew correction (correction of angular displacement) of the sheet P by changing the sheet P being conveyed in the sheet conveyance passage, in the angular direction (i.e., the direction parallel to a plane of the sheet P).

Further, while holding and conveying the sheet P, the pair of sheet holding rollers 31 moves in the width direction, based on the detection results of two of the three CISs, which are the first upstream side CIS 35, the second upstream side CIS 36 and the downstream side CIS 37. By so doing, the pair of sheet holding rollers 31 corrects the lateral displacement amount for multiple times. That is, the pair of sheet holding rollers 31 functions as a member to perform correction of lateral displacement of the sheet P by changing the sheet P being conveyed in the sheet conveyance passage, to the width direction.

Here, the third pair of sheet conveying rollers 44 is disposed upstream from the pair of sheet holding rollers 31 in the sheet conveying direction (i.e., at the upstream side of the sheet conveying direction). The third pair of sheet conveying rollers 44 is a pair of sheet conveying rollers that conveys the sheet P by rotating while holding the sheet P and that has the rollers separatable from each other to switch between a sheet holding state and a non sheet holding state. After the sheet P has reached and contacted the pair of sheet holding rollers 31 to be conveyed while being held by the pair of sheet holding rollers 31. In this state, the third pair of sheet conveying rollers 44 that is holding the sheet P releases the sheet P to switch the sheet holding state to the non sheet holding state.

Further, in Embodiment 1, the pair of sheet holding rollers 31 also functions as a pair of registration rollers that is disposed upstream from the transfer roller 7 (and the photoconductor drum 5) that functions as a downstream side sheet conveying roller in the sheet conveyance passage in the sheet conveying direction. By rotating while holding the sheet P, the pair of sheet holding rollers 31 conveys the sheet P (i.e., the sheet after the pair of sheet holding rollers 31 has corrected the angular displacement and the lateral displacement) toward the transfer nip region.

The first drive motor 59 that drives and rotates (the drive roller 31*a* of) the pair of sheet holding rollers 31 is a driving motor with variable number of rotations to change a speed of conveyance of the sheet P. Then, when a sheet detecting sensor that is a photosensor detects the timing of arrival of the sheet P at the pair of sheet holding rollers 31, that is, when a state in which the sheet contacts the nip region of the pair of sheet holding rollers 31 and the pair of sheet holding rollers 31 holds the sheet P is detected), the pair of sheet holding rollers 31 performs a desired lateral displacement correction and a desired angular displacement correction, and the speed of conveyance of the sheet P by the pair of sheet holding rollers 31 is changed based on the detection result (that is, the timing of arrival of the sheet P at the pair of sheet holding rollers 31) of the sheet detecting sensor. Specifically, in order to synchronize the timing at which the pair of sheet holding rollers 31 conveys the sheet P to the transfer roller 7 and the timing at which the toner image formed on the surface of the photoconductor drum 5 reaches the transfer roller 7, the speed of conveyance of the sheet P conveyed by the pair of sheet holding rollers 31 is varied, that is, the timing to convey the sheet P toward the transfer nip region is adjusted. By so doing, the pair of sheet holding rollers 31 can correct the lateral displacement and the angular displacement of the sheet P without stopping the conveyance of the sheet P and can transfer the toner image onto the sheet P at a desired position.

It is to be noted that, immediately after the leading end of the sheet P has reached the transfer nip region, the speed of conveyance of the sheet P conveyed by the pair of sheet holding rollers 31 is adjusted, so as not to cause a linear velocity difference with the photoconductor drum 5 to result in distortion of the toner image to be transferred onto the sheet P, in other words, the speed of conveyance of the sheet P is adjusted to cause the linear velocity difference with the photoconductor drum 5 to be 1.

As illustrated in FIG. 3, two CISs, that is, the first upstream side CIS 35 and the second upstream side CIS 36 are disposed upstream from the pair of sheet holding rollers 31 (a pair of rollers) in the sheet conveying direction. The first upstream side CIS 35 and the second upstream side CIS 36 function as a first detector to optically detect each attitude of the sheet at the respective positions. The first upstream side CIS 35 is disposed upstream from the pair of sheet holding rollers 31 (a pair of rollers) and downstream from the third pair of sheet conveying rollers 44 in the sheet conveying direction. The second upstream side CIS 36 is disposed upstream from the pair of sheet holding rollers 31 (a pair of rollers) and downstream from the first upstream side CIS 35 in the sheet conveying direction.

Further, the downstream side CIS 37 is disposed downstream from the pair of sheet holding rollers 31 in the sheet conveying direction. The downstream side CIS 37 functions as a second detector to optically detect the attitude of the sheet P at the position. The downstream side CIS 37 (a second detector) is disposed downstream from the pair of sheet holding rollers 31 and upstream from the transfer roller 7 (a pair of downstream side sheet conveying rollers) in the sheet conveying direction.

Each of the first upstream side CIS 35, the second upstream side CIS 36 and the downstream side CIS 37 includes multiple photosensors (i.e., light emitting elements such as LEDs and light receiving elements such as photodiodes) disposed equally spaced apart in the width direction of the sheet P. Each of the first upstream side CIS 35, the second upstream side CIS 36 and the downstream side CIS 37 detects a position of the side edge Pa (the edge portion) on one end in the width direction of the sheet P. That is, each of the first upstream side CIS 35, the second upstream side CIS 36 and the downstream side CIS 37 functions as a detector to optically detect the attitude of the sheet P in the sheet conveyance passage.

In Embodiment 1, the first upstream side CIS 35 and the second upstream side CIS 36 (or the second upstream side CIS 36 and the downstream side CIS 37) detect the lateral displacement amount (a lateral registration amount) of the sheet P being conveyed in the sheet conveyance passage of the sheet conveying device 30. Then, based on the detection results, the pair of sheet holding rollers 31 corrects the lateral displacement amount while holding and conveying the sheet P.

As an example, with reference to FIG. 3, the first upstream side CIS 35 and the second upstream side CIS 36 (or the second upstream side CIS 36 and the downstream side CIS 37) detect a state in which the sheet P is moved toward one end in the width direction (toward a lower side in FIG. 3) by a distance a relative to a reference position (that is, a home position of the sheet P without any displacement in the width direction) indicated by a dotted line. When this state of the sheet P is detected, a controller 90 (see FIG. 6) determines a distance a, in other words, the amount of lateral displacement, as a correction amount, and causes the pair of sheet holding rollers 31 (together with the holding member 72) to move by the distance a toward an opposite side in the width direction (toward an upper side in FIG. 3) while the pair of sheet holding rollers 31 is holding and conveying the sheet P (i.e., the shift control is performed).

Specifically, the first upstream side CIS 35 (or the second upstream side CIS 36) detects a lateral displacement amount M1 of the sheet P and the second upstream side CIS 36 (or the downstream side CIS 37) detects a lateral displacement amount M2 of the sheet P. Then, based on the mean value of the lateral displacement amount M1 and the lateral displacement amount M2, that is, a mean value ((M1+M2)/2), the lateral displacement amount of the sheet P is detected. A correction amount of the above-described mean value ((M1+M2)/2) is represented as a correction amount $\alpha$. Then, in order to cancel out the correction amount $\alpha$, the pair of sheet holding rollers 31 (together with the holding member 72) is moved while the pair of sheet holding rollers 31 is holding and conveying the sheet P, that is, the shift control is performed.

To be more specific, in a calculator (the controller 90), the lateral displacement amount $\alpha$ is calculated based on the detection results obtained by the first upstream side CIS 35 and the second upstream side CIS 36 (or the second upstream side CIS 36 and the downstream side CIS 37), and then the number of counts p2 of a third drive motor encoder 47 (i.e., a shift motor encoder) of the third drive motor 63 (i.e., a shift motor) is calculated based on the lateral displacement amount $\alpha$. Then, the number of counts p2 is stored as "the number of counts p2 of a target sheet conveying encoder" of the third drive motor 63 a shift motor). Then, while detecting the shift position (a position in the width direction) by the third drive motor encoder 47 (i.e., a shift motor encoder), in other words, while performing a feedback control, based on the above-described "number of counts p2 of a target sheet conveying encoder", a third drive motor driver 46 is controlled by a third drive motor control unit 45 (i.e., a shift controller) to drive the third drive motor 63 (i.e., a shift motor).

It is to be noted that, for calculation of "the number of counts of a target sheet conveying encoder", a correction amount (a sheet conveyance amount) per count (pulse) is previously obtained by calculating with the set value and stored in the calculator.

Further, in Embodiment 1, the first upstream side CIS 35 and the second upstream side CIS 36 (or the second upstream side CIS 36 and the downstream side CIS 37) detect the angular displacement amount (skew amount) of the sheet P being conveyed in the sheet conveyance passage of the sheet conveying device 30. Then, based on the detection results, the pair of sheet holding rollers 31 corrects the angular displacement amount while holding and conveying the sheet P.

As an example, referring to FIG. 3, the first upstream side CIS 35 and the second upstream side CIS 36 (or the second upstream side CIS 36 and the downstream side CIS 37)

detect a state in which the sheet P is rotated in a normal angular direction by an angle β relative to a reference position (that is, a home position of the sheet P without any displacement in the angular direction) indicated by a dotted line. When this state of the sheet P is detected, the controller 90 (see FIG. 6) determines an angle β, in other words, the amount of angular displacement, as a correction amount, and causes the pair of sheet holding rollers 31 (together with the holding member 72) to rotate by the angle β toward an opposite side (in an opposite direction to the angular direction and in a clockwise direction in FIG. 3) while the pair of sheet holding rollers 31 is holding the sheet P (i.e., the rotational control is performed).

Figure 14:
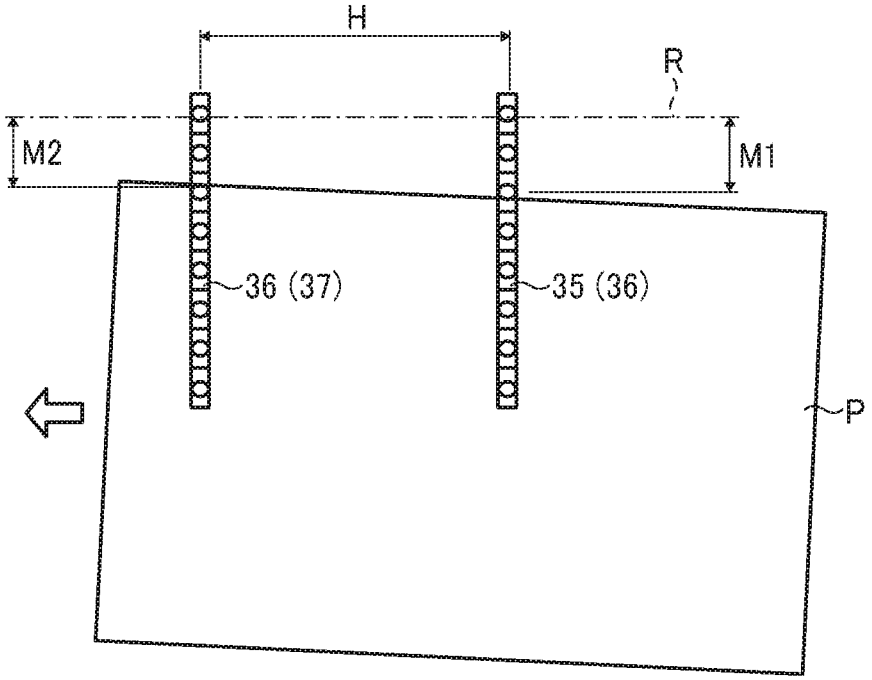
FIG. 14 is a diagram illustrating two CISs and a sheet having positional deviations in a width direction of the sheet and a rotational direction of the sheet.

To be more specific, referring to FIG. 14, the first upstream side CIS 35 (or the second upstream side CIS 36) detects the lateral displacement amount M1 of the sheet P and the second upstream side CIS 36 (or the downstream side CIS 37) detects the lateral displacement amount M2 of the sheet P. The angular displacement amount of the sheet P is obtained based on a value ((M2−M1)/H), which is obtained by dividing the difference (M2−M1), i.e., the difference of the lateral displacement amount M1 of the sheet P obtained by the first upstream side CIS 35 (or the second upstream side CIS 36) and the lateral displacement amount M2 of the sheet P obtained by the second upstream side CIS 36 (or the downstream side CIS 37), by a separation distance of the first upstream side CIS 35 and the second upstream side CIS 36 (or the second upstream side CIS 36 and the downstream side CIS 37) in the sheet conveying direction. The correction amount (angle) β to be corrected is obtained with the value ((M2−M1)/H) as tan β. Then, in order to cancel out the correction amount (angle) β, the pair of sheet holding rollers 31 (together with the holding member 72) is moved in the opposite direction while the pair of sheet holding rollers 31 is holding the sheet P, that is, the rotational control is performed.

It is to be noted that both of the above-described lateral displacement amount M1 of the sheet P and the above-described lateral displacement amount M2 of the sheet P are respective amounts of lateral displacement of the sheet P from a reference position R indicated with a dotted line (i.e., a position without no lateral displacement of the sheet P).

To be more specific, in the calculator (the controller 90), the angular displacement amount β is calculated based on the detection results obtained by the first upstream side CIS 35 and the second upstream side CIS 36 (or the second upstream side CIS 36 and the downstream side CIS 37), and then the number of counts p1 of a second drive motor encoder 27 (i.e., a rotation motor encoder) of the second drive motor 62 (i.e., a rotation motor) is calculated based on the angular displacement amount β. Then, the number of counts q1 is stored as "the number of counts q1 of a target sheet conveying encoder" of the second drive motor 62 (i.e., a rotation motor). Then, while detecting the rotation position (a position in the angular direction) by the second drive motor encoder 27 (i.e., a rotation motor encoder), in other words, while performing a feedback control, based on the above-described "number of counts p1 of a target sheet conveying encoder", a second drive motor driver 26 is controlled by a second drive motor control unit 25 (i.e., a rotation controller, to drive the second drive motor 62 (i.e., a rotation motor).

As described above, in Embodiment 1, the angular displacement amount is corrected by causing the pair of sheet holding rollers 31 to rotate in the angular direction based on the detection results of multiple CISs, which are the first upstream side CIS 35, the second upstream side CIS 36 and the downstream side CIS 37 while the pair of sheet holding rollers 31 is holding and conveying the sheet P without stopping the conveyance of the sheet P. And, at the same time, the lateral displacement amount of the sheet is corrected by causing the pair of sheet holding rollers 31 to move in the width direction of the sheet P.

By so doing, when compared with a configuration in which the angular displacement correction and the lateral displacement correction are performed while stopping conveyance of the sheet P, the pair of sheet holding rollers 31 can enhance the productivity of a sheet conveying device and an image forming apparatus significantly. Further, when the angular displacement amount and the lateral displacement amount are corrected, a linear velocity difference is not caused between multiple rollers separated apart in the width direction of the pair of sheet holding rollers 31. Therefore, even when a sheet P such as a thin paper or a sheet having a low coefficient of friction on the surface is conveyed, the sheet P is not warped or slipped.

Consequently, in Embodiment 1 of this disclosure, the pair of sheet holding rollers 31 performs the angular and lateral displacement corrections of the sheet P at two steps, with the first upstream side CIS 35, the second upstream side CIS 36 and the downstream side CIS 37 disposed along the sheet conveyance passage.

Specifically, the first upstream side CIS 35 and the second upstream side CIS 36 detect an angular displacement amount and a lateral displacement amount of the sheet P while the pair of sheet holding rollers 31 is holding and conveying the sheet P. Then, based on the detection results, the angular displacement correction of the sheet P is performed and at the substantially same time, the lateral displacement correction of the sheet P is performed. Hereinafter, the above-described angular and lateral displacement corrections are collectively referred to as a "primary correction." Further, after the primary correction has been performed, the second upstream side CIS 36 and the downstream side CIS 37 detect an angular displacement amount and a lateral displacement amount of the sheet P while the pair of sheet holding rollers 31 is holding and conveying the sheet P. Then, based on the detection results, the angular displacement correction of the sheet P is performed and at the substantially same time, the lateral displacement correction of the sheet P is performed. Hereinafter, the above-described angular and lateral displacement corrections are collectively referred to as a "secondary correction (recorrection)."

It is to be noted that, in the secondary correction (recorrection), a correcting operation to correct the attitude of the sheet Pin the angular direction and the width direction based on the detection result of the first detector (either one of the first upstream side CIS 35 and the second upstream side CIS 36) and the detection result of the second detector (the downstream side CIS 37) is repeated for a period until the leading end of the sheet P reaches the transfer nip region. Details of the correcting operation are described below.

Here, in Embodiment 1, before the sheet P is conveyed to the pair of sheet holding rollers 31, the second drive motor 62 (the rotation device) causes the pair of sheet holding rollers 31 to rotate from an angular home position (which is a normal position corresponding to the sheet P that has no angular displacement) to correctly face the sheet P according to the angular displacement amount of the sheet P and the third drive motor 63 (the moving device) causes the pair of sheet holding rollers 31 to move in the width direction from a lateral home position (which is a normal position corresponding to the sheet P that has no lateral displacement)

according to the lateral displacement amount of the sheet P, based on the detection result of the first detector (i.e., the first upstream side CIS 35 and the second upstream side CIS 36).

Then, while the pair of sheet holding rollers 31 is holding the sheet P, the second drive motor 62 (the rotation device) causes the pair of sheet holding rollers 31 to rotate to the angular home position to correct the angular displacement amount and the third drive motor 63 (the moving device) causes the pair of sheet holding rollers 31 to move in the width direction to the lateral home position to correct the lateral displacement amount.

The above-described series of correcting operations is the "primary correction."

After completion of the primary correction, a recorrecting operation is repeated to the extent possible.

Specifically, after the pair of sheet holding rollers 31 has corrected the attitude of the sheet P (that is, the angular and lateral displacement amounts of the sheet P), the first detector (either one of the first upstream side CIS 35 and the second upstream side CIS 36) and the second detector (the downstream side CIS 37) disposed with the pair of sheet holding rollers 31 therebetween detect the attitude of the sheet P. Then, the attitude of the sheet P (that is, the angular and lateral displacement amounts) is further corrected based on the detection results of the first detector and the second detector. It is to be noted that, in Embodiment 1, out of the two upstream side CISs (i.e., the first upstream side CIS 35 and the second upstream side CIS 36), the second upstream side CIS 36 is employed as a first detector in the recorrection (the secondary correction).

Specifically, in the recorrection (the secondary correction), based on the detection results of the second upstream side CIS 36 and the downstream side CIS 37, the pair of sheet holding rollers 31 rotates from the above-described angular home position while holding the sheet P to further correct the angular displacement amount of the sheet P and moves in the width direction from the above-described lateral home position while holding the sheet P to further correct the lateral displacement amount of the sheet P.

As described above, the pair of sheet holding rollers 31 has performed the angular and lateral displacement corrections once while holding and conveying the sheet P, based on the detection results obtained before the sheet P is held by the pair of sheet holding rollers 31. After completion of the above-described corrections, the angular and lateral displacement of the sheet P are corrected again based on the detection results obtained by the second upstream side CIS 36 and the downstream side CIS 37 while the pair of sheet holding rollers 31 is holding and conveying the sheet P. The reasons for performing the above-described corrections are that the angular displacement and the lateral displacement may occur to the sheet P by a small amount due to shock or impact generated when the sheet P enters into the nip region of the pair of sheet holding rollers 31 and, at the same time, due to eccentricity of the roller or rollers of the pair of sheet holding rollers 31 or failure in assembly.

By contrast, in Embodiment 1 of this disclosure, the pair of sheet holding rollers 31 corrects the lateral and angular displacements of the sheet P while holding and conveying the sheet P, based on the detection results obtained before the sheet P is held by the pair of sheet holding rollers 31. After completion of the above-described corrections, the pair of sheet holding rollers 31 corrects the lateral and angular displacements of the sheet P again while holding and conveying the sheet P, based on the detection results obtained by the second upstream side CIS 36 and the downstream side CIS 37 after the sheet P is held by the pair of sheet holding rollers 31. Accordingly, the above-described possible inconvenience or failure is restrained, and therefore the lateral and angular displacements are corrected with higher accuracy.

In Embodiment 1, when the second upstream side CIS 36 and the downstream side CIS 37 are caused to function as detectors (i.e., the first detector and the second detector) to performed the secondary correction, the lateral and angular displacement amounts of the sheet P are corrected by the feedback control based on the detection results that are substantially continuously obtained by the second upstream side CIS 36 and the downstream side CIS 37. That is, the second upstream side CIS 36 and the downstream side CIS 37 continuously detect respective position information of the sheet P in the secondary correction. Then, the angular and lateral displacement amounts of the sheet P are calculated based on the respective position information of the sheet P detected by the second upstream side CIS 36 and the downstream side CIS 37 and fed back to the controller 90. Then, the angular and lateral displacement correction amounts of the sheet P (i.e., the numbers of encoder counts) are corrected continuously, and the second drive motor 62 and the third drive motor 63 are controlled based on the correction amounts. The above-described recorrecting operation is repeated to the extent possible for a period immediately before the leading end of the sheet P reaches the transfer nip region.

By performing the feedback control as described above, the positional deviation (i.e., the lateral displacement and the angular displacement) of the sheet P that may occur in the recorrection (the secondary correction) and the correction error in the secondary correction can be modified with good responsiveness, and therefore the correction of lateral displacement and angular displacement can be performed with higher accuracy.

Figure 5:
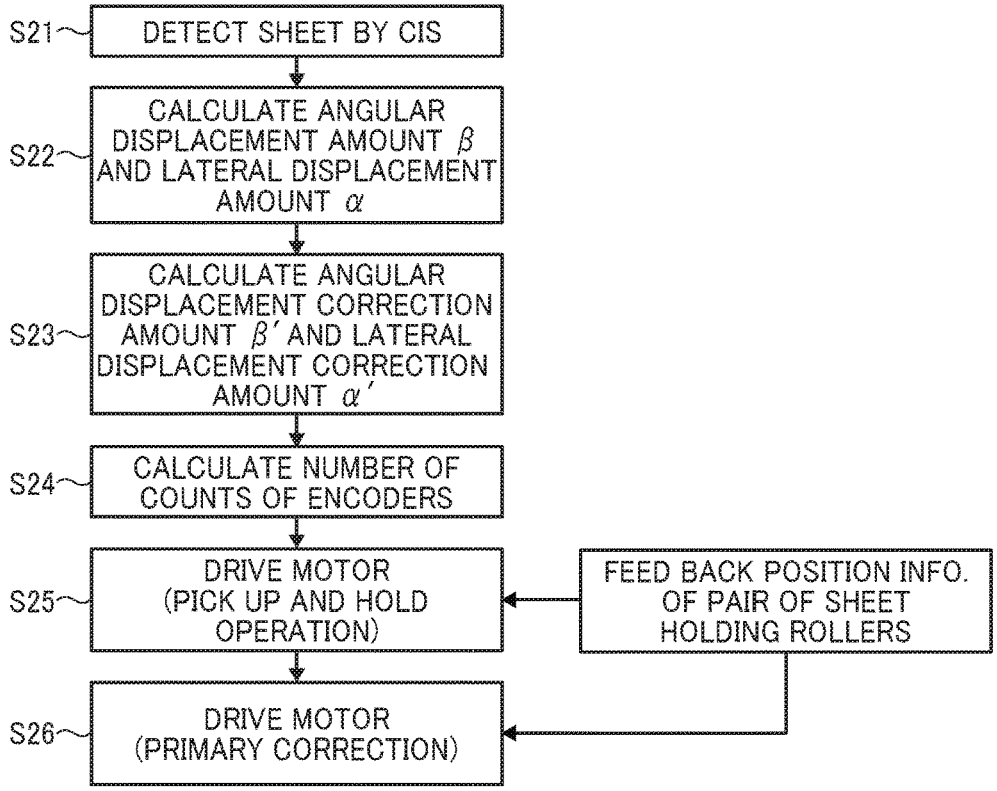
FIG. 5 is a flowchart of control operations of a primary correction.
Figure 6:
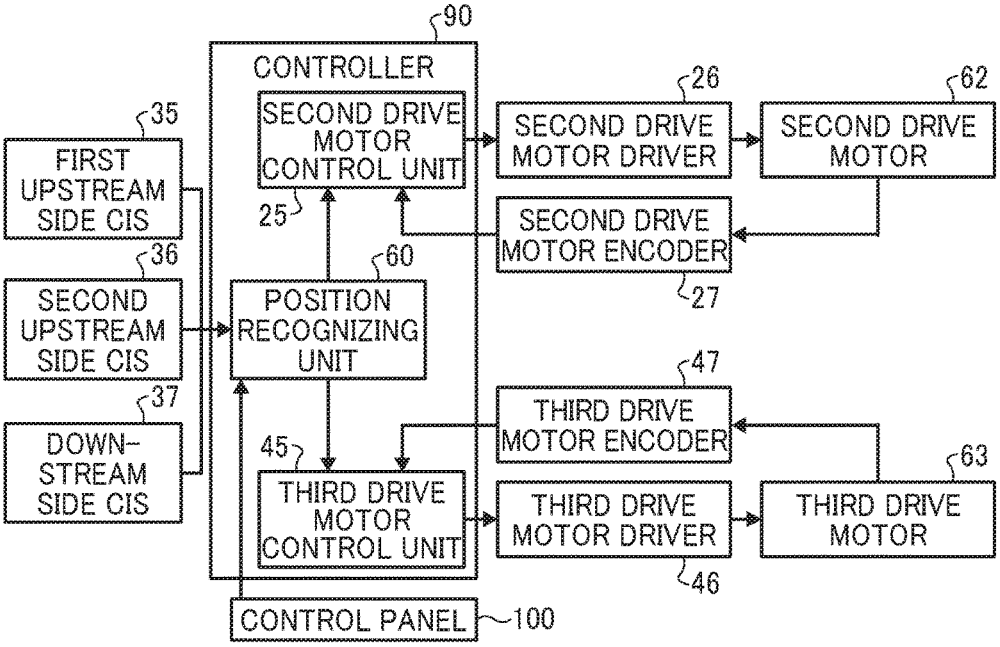
FIG. 6 is a block diagram illustrating a controller.

Now, a description is given of the primary correction performed in the sheet conveying device 30 according to this disclosure, with reference to FIGS. 5 and 6.

FIG. 5 is a flowchart of control operations of the primary correction. FIG. 6 is a block diagram illustrating the controller 90 and components related to the primary correction (or the secondary correction).

As illustrated in FIG. 5, the respective CISs, which are the first upstream side CIS 35 and the second upstream side CIS 36 in the primary correction, detect the sheet P, in step S21. Then, the lateral displacement amount $\alpha$ of the sheet P and the angular displacement amount $\beta$ of the sheet P are calculated, in step S22. Based on the lateral displacement amount $\alpha$ and the angular displacement amount $\beta$ detected in step S22, the lateral displacement correction amount $\alpha'$ and the angular displacement correction amount $\beta'$ for the primary correction are determined in step S23.

Then, based on the lateral displacement correction amount $\alpha'$ of the sheet P and the angular displacement correction amount $\beta'$ of the sheet P, encoders, i.e., the second drive motor encoder 27 and the third drive motor encoder 47 in FIG. 6 calculate respective numbers of counts thereof, in step S24.

Thereafter, according to the number of counts of the second drive motor encoder 27 and the number of counts of the third drive motor encoder 47, the respective motor drivers, i.e., the second drive motor driver 26 and the third drive motor driver 46 in FIG. 6 drive the second drive motor 62 and the third drive motor 63, respectively, and the pair of sheet holding rollers 31 is rotated in the rotation direction and moved in the width direction to perform a pick up and hold operation, in step S25.

While holding and conveying the sheet P driven by the second drive motor 62 and the third drive motor 63, the pair of sheet holding rollers 31 is rotated and moved to return to the home position. Accordingly, the pair of sheet holding rollers 31 performs the angular and lateral displacement corrections of the sheet P, i.e., the primary correction, in step S26.

It is to be noted that, when the pick up and hold operation in step S25 and the primary correction in step S26 are performed, the second drive motor encoder 27 and the third drive motor encoder 47 feed back the respective position information of the pair of sheet holding rollers 31 continuously. Accordingly, the pair of sheet holding rollers 31 is controlled to rotate and move by the determined amount of movement.

In FIG. 6, the controller 90 controls various operations in the image forming apparatus 1.

A position recognizing unit 60 in the controller 90 counts the lateral displacement amount of the sheet P and the angular displacement amount of the sheet P based on information received from the first upstream side CIS 35, the second upstream side CIS 36 and the downstream side CIS 37 and recognizes reflectance of the sheet Phased on the detection result obtained by the first upstream side CIS 35 (or information input via a control panel 100).

A position recognizing unit 60 in the controller 90 counts the lateral displacement amount of the sheet P and the angular displacement amount of the sheet based on information received from the first upstream side CIS 35, the second upstream side CIS 36 and the downstream side CIS 37 and recognizes reflectance of the sheet P based on the detection result obtained by first upstream side CIS 35 (or information input via the control panel 100).

Further, the second drive motor control unit 25 determines the amounts of driving of the second drive motor 62 (i.e., the rotation angle and rotational direction of the second drive motor 62) based on the amount of angular displacement of the sheet P obtained by the position recognizing unit 60. Further, the third drive motor control unit 45 determines the amounts of driving of the third drive motor 63 (i.e., the rotation angle and rotational direction of the third drive motor 63) based on the amount of lateral displacement of the sheet P obtained by the position recognizing unit 60.

The second drive motor driver 26 receives a signal from the second drive motor control unit 25 to drive the second drive motor 62. Similarly, the third drive motor driver 46 receives a signal from the third drive motor control unit 45 to drive the third drive motor 63. The second drive motor encoder 27 detects the amount of rotation of the second drive motor 62 and the third drive motor encoder 47 detects the amount of rotation of the third drive motor 63.

Figure 7:
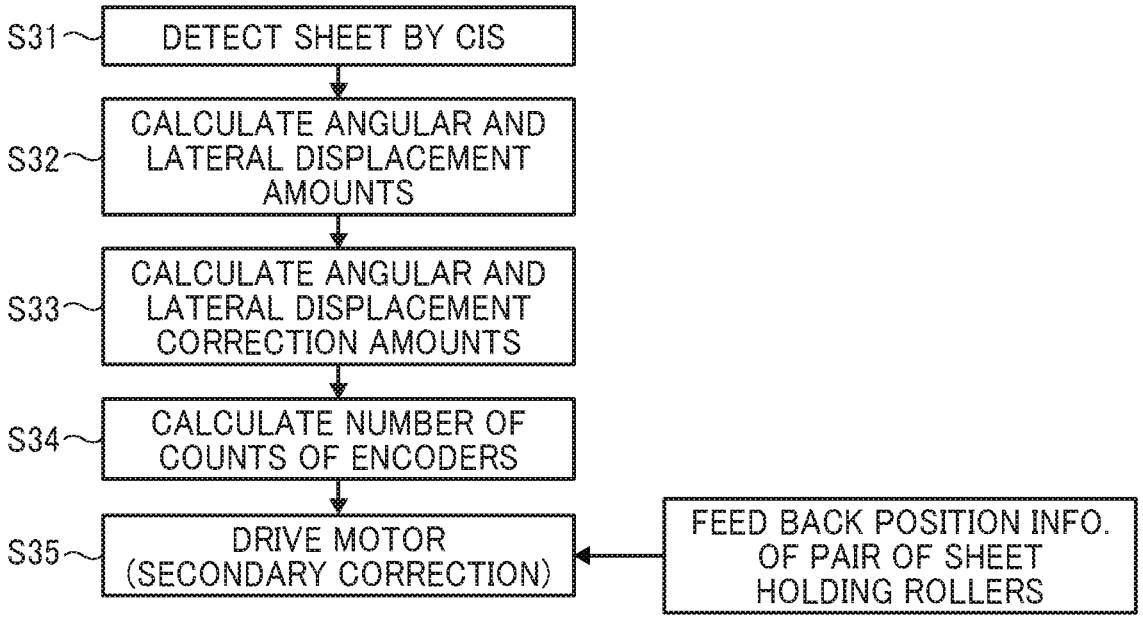
FIG. 7 is a flowchart of control operations of a secondary correction.

FIG. 7 is a flowchart of control operations of the secondary correction (the recorrection).

As illustrated in FIG. 7, firstly in the secondary correction, the second upstream side CIS 36 and the downstream side CIS 37 detect the sheet P, in step S31. Then, similar to the operation in the primary correction, the lateral displacement amount of the sheet P and the angular displacement amount of the sheet P are calculated, in step S32. Then, based on the detection results, the lateral displacement correction amount of the sheet and the angular displacement correction amount of the sheet P are calculated, in step S33. Then, respective encoders (i.e., the second drive motor encoder 27 and the third drive motor encoder 47 in FIG. 6) calculate the respective numbers of counts, in step S34. Thereafter, respective drive motor drivers (i.e., the second drive motor driver 26 and the third drive motor driver 46 in FIG. 6) drive the second drive motor 62 and the third drive motor 63 according to the calculated numbers of counts of the encoders (i.e., the second drive motor encoder 27 and the third drive motor encoder 47) to perform secondary correction, in step S35.

In the secondary correction, the second upstream side CIS 36 and the downstream side CIS 37 continuously detect the position information of the sheet P after the start of the secondary correction. The lateral displacement amount of the sheet P and the angular displacement amount of the sheet P are calculated based on the position information detected by the second upstream side CIS 36 and the downstream side CIS 37, and then the amounts are fed back to the controller 90 where the numbers of counts of the respective encoders (that is, the lateral displacement correction amount of the sheet P and the angular displacement correction amount of the sheet P) are updated consecutively. By performing the feedback control as described above, the positional deviation of the sheet P that may occur in the secondary correction and the correction error in the secondary correction can be modified, and therefore the correction with higher accuracy can be performed.

Now, a description is given of an example of operations of the sheet conveying device 30 having the above-described configuration, with reference to FIGS. 8A through 8F and 9A through 9F.

Figure 8A:
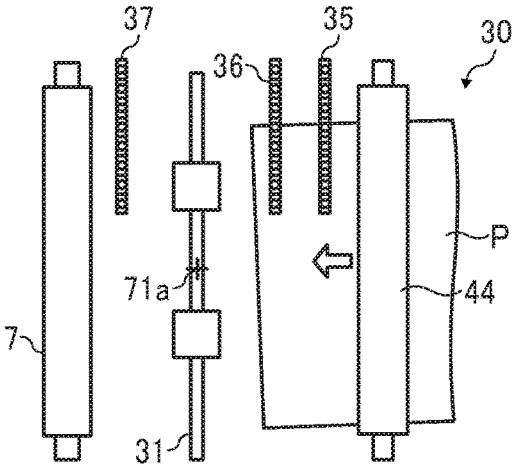
FIGS. 8A, 8B, 8C, 8D, 8E and 8F are schematic diagrams illustrating operations performed by the sheet conveying device.
Figure 8B:
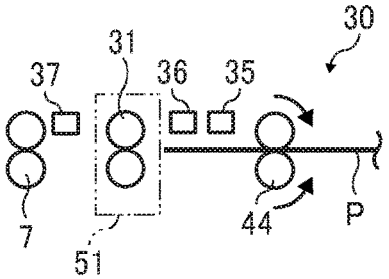
Figure 8C:
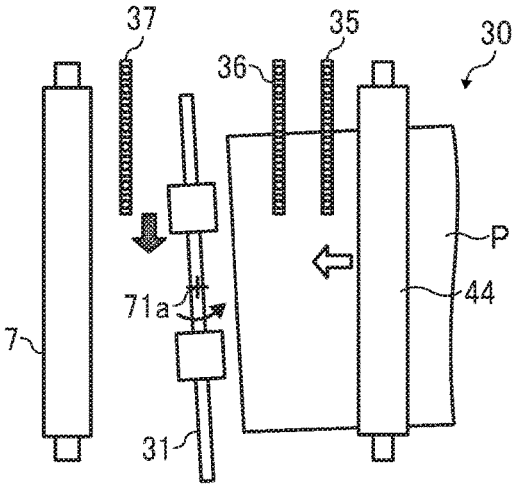
Figure 8D:
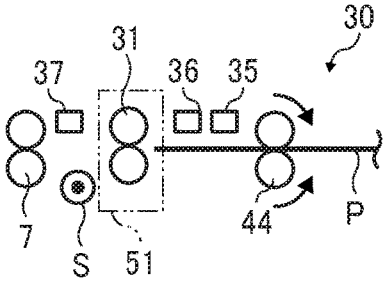
Figure 8E:
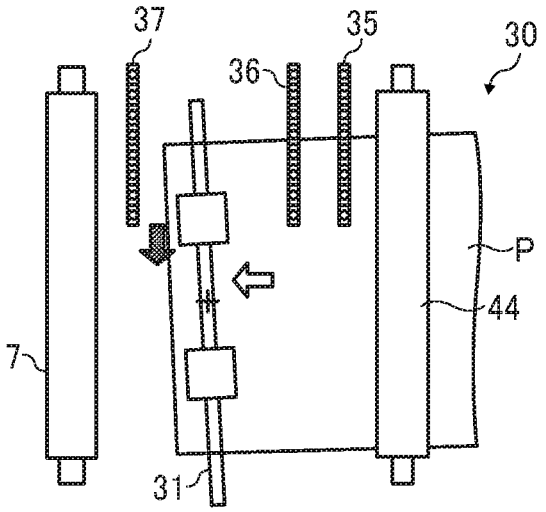
Figure 8F:
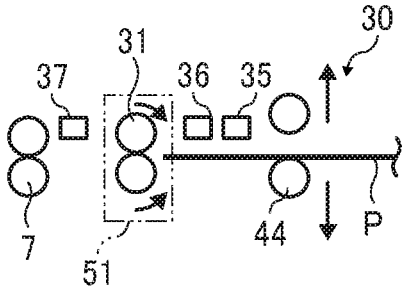
Figure 9A:
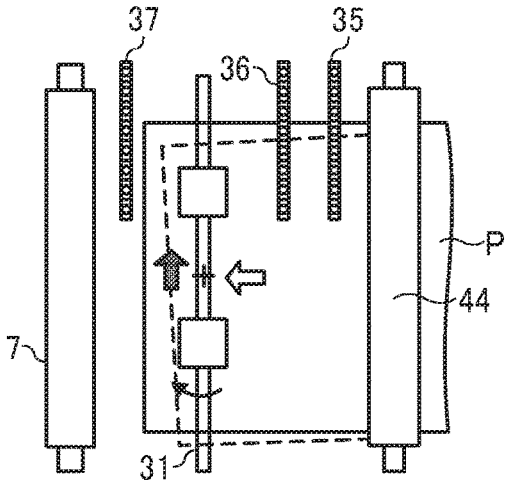
FIGS. 9A, 9B, 9C, 9D, 9E and 9F are diagrams illustrating operations performed by the sheet conveying device, subsequent from the operations of FIGS. 8A through 8F.
Figure 9B:
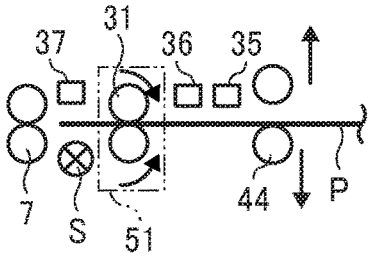
Figure 9C:
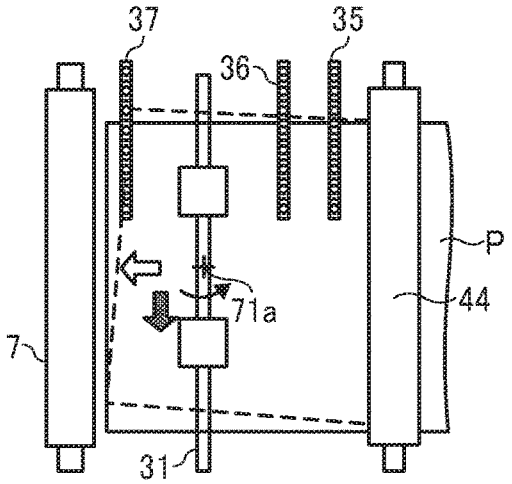
Figure 9D:
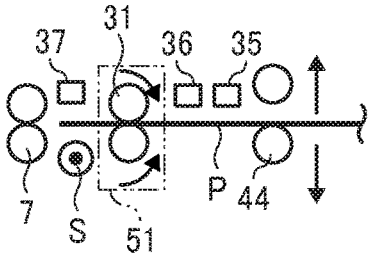

It is to be noted that FIGS. 8A, 8C, 8E, 9A, 9C and 9E are top views illustrating operations of the sheet conveying device 30 in this order and that FIGS. 8B, 8D, 8F, 9B, 9D and 9F are side views illustrating the operations of the sheet conveying device 30 corresponding to FIGS. 8A, 8C, 8E, 9A, 9C and 9E, respectively. Further, respective indications with reference letter S in FIGS. 8D, 9B and 9D represent respective arrows moving in the width direction of the pair of sheet holding rollers 31.

First, as illustrated in FIGS. 8A and 8B, the sheet P fed from the first sheet feeding unit 12 is held and conveyed by the third pair of sheet conveying rollers 44 toward the pair of sheet holding rollers 31 in a direction indicated by white arrow. At this time, the position of the pair of sheet holding rollers 31 in the rotation direction is located in the angular home position, which is a normal position corresponding to the sheet P that has no angular displacement, and the position thereof in the width direction is located in the lateral home position, which is a normal position corresponding to the sheet P that has no lateral displacement.

Then, when the sheet P passes the first upstream side CIS 35 and reaches the second upstream side CIS 36, the first upstream side CIS 35 and the second upstream side CIS 36 detect the lateral displacement amount $\alpha$ of the sheet P. Then, the angular displacement amount $\beta$ of the sheet P is detected by the first upstream side CIS 35 and the second upstream side CIS 36.

Then, as illustrated in FIGS. 8C and 81), the pair of sheet holding rollers 31 moves together with the holding member 72 from the angular home position by the angle $\beta$ about the shaft 71*a* in the same angular direction as the angular displacement amount $\beta$ that is detected by the first upstream side CIS 35 and the second upstream side CIS 36 (the first detector), and at the same time moves from the second home position by the distance $\alpha$ in the same width direction as the lateral displacement amount $\alpha$ that is detected by the first upstream side CIS 35 and the second upstream side CIS 36.

Then, as illustrated in FIGS. 8E and 8F, the pair of sheet holding rollers 31 starts to rotate (in a direction indicated by arrow in FIG. 8F) immediately before the leading end of the sheet P reaches the pair of sheet holding rollers 31. Consequently, as the sheet P is held and conveyed by the pair of sheet holding rollers 31, the third pair of sheet conveying rollers 44 opens the sheet conveyance passage and moves to a direction indicated by arrow in FIG. 9F in which the third pair of sheet conveying rollers 44 does not hold the sheet P.

It is to be noted that the calculator (i.e., the controller 90) can obtain a time at which the leading end of the sheet P contacts the pair of sheet holding rollers 31, based on a time at which the first upstream side CIS 35 and the second upstream side CIS 36 (the first detector) detect the leading end of the sheet P, a speed of conveyance of the sheet P and a distance from the positions of the first upstream side CIS 35 and the second upstream side CIS 36 to the position of the pair of sheet holding rollers 31.

Then, as illustrated in FIGS. 9A and 9B, while holding and conveying the sheet P, the pair of sheet holding rollers 31 rotates about the shaft 71*a* to return to the angular home position such that the angular displacement amount β of the sheet P detected by the first upstream side CIS 35 and the second upstream side CIS 36 is canceled out, and at the same time moves in the width direction to return to the lateral home position such that the lateral displacement amount α of the sheet P detected by the first upstream side CIS 35 and the second upstream side CIS 36 is canceled out.

Then, as illustrated in FIGS. 9C and 9D, when the sheet P after completion of the above-described correction reaches the position of the downstream side CIS 37, the second upstream side CIS 36 (the first detector) and the downstream side CIS 37 (the second detector) substantially continuously detect the angular displacement amount β of the sheet P. Further, the second upstream side CIS 36 (the first detector) and the downstream side CIS 37 (the second detector) substantially detect the lateral displacement amount α of the sheet P. Then, the pair of sheet holding rollers 31 rotates together with the holding member 72 from the angular home position by the angle β about the shaft 71*a* in a different angular direction (i.e., the opposite direction) according to the angular displacement amount β that is substantially continuously detected by the second upstream side CIS 36 (the first detector) and the downstream side CIS 37 (the second detector), and at the same time, moves from the lateral home position by the distance α in a different width direction (i.e., the opposite direction) according to the lateral displacement amount α that is substantially continuously detected by the second upstream side CIS 36 (the first detector) and the downstream side CIS 37 (the second detector).

Thus, the sheet P is conveyed toward the transfer roller 7 (the transfer nip region) while the angular displacement correction and the lateral displacement correction are performed continuously. At this time, the number of rotations of the pair of sheet holding rollers 31 (the speed of conveyance of the sheet P until the sheet P arrives the transfer roller 7) is varied so as to synchronize with movement of the toner image formed on the surface of the photoconductor drum 5.

Figure 9E:
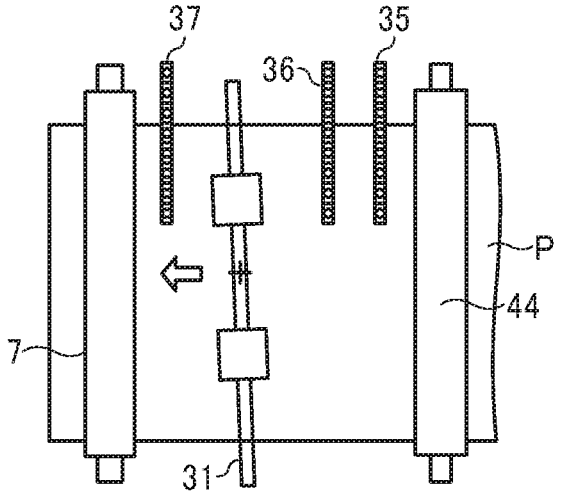
Figure 9F:
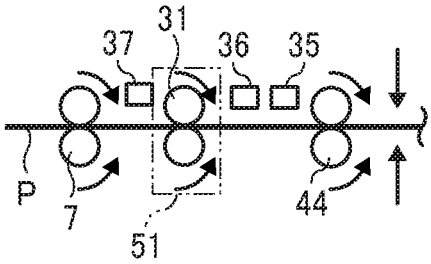

Then, as illustrated in FIGS. 9E and 9F, the sheet P is conveyed toward the transfer roller 7 (the image transfer area, i.e., the transfer nip region) and the toner image is transferred onto the sheet P at a desired position. Thereafter, the third pair of sheet conveying rollers 44 in a roller separating state is returned to a roller contact state (FIG. 8B) and supports the pair of sheet holding rollers 31 to convey the sheet P and, at the same time, prepare a subsequent conveyance of the sheet P.

Then, as the trailing end of the sheet P passes the pair of sheet holding rollers 31, the pair of sheet holding rollers 31 is returned to the angular home position and the lateral home position for preparation of the angular displacement correction and the lateral displacement correction of a subsequent sheet P.

Now, a detailed description is given of the configuration and functions of the sheet conveying device 30 according to Embodiment 1, with reference to FIGS. 10 through 13. In the sheet conveying device 30 (the image forming apparatus 1) according to Embodiment 1, a reference color of the sheet P to be conveyed is set to white. The reason why the color of white is set is that white papers are generally used as a sheet P highly frequently.

Therefore, assuming that a sheet P having the reference color (hereinafter, occasionally referred to as the "white sheet P") is mainly conveyed, the sheet conveying device 30 has a configuration in which the first upstream side CIS 35, the second upstream side CIS 36 and the downstream side CIS 37 detect the side edge Pa of the sheet P with high accuracy. Specifically, in the sheet conveying device 30, respective portions or an entire portion (of a part of the apparatus body) facing the first upstream side CIS 35, the second upstream side CIS 36 and the downstream side CIS 37 are formed to have a color of the high optical absorptivity such as black. According to this configuration, light emitted from each light emitting element has different incidence rates of the reflected light on the white sheet P from the side edge Pa as the boundary. That is, the incidence rate of the reflected light in the light receiving element is relatively low on the outer side of the sheet P and the incidence rate of the reflected light in the light receiving element is relatively high on the inner side of the sheet P. Thus, the overall output waveform of the first upstream side CIS 35, the second upstream side CIS 36 and the downstream side CIS 37 clearly has a difference in height, and therefore the position of the side edge Pa of the sheet P is detected with high accuracy.

However, in a case in which a sheet P that has a color having different reflectance to white (a reference color, e.g., black or gray) is conveyed, the first upstream side CIS 35, the second upstream side CIS 36 and the downstream side CIS 37 cannot detect the position of the side edge Pa of the sheet P as it is.

Specifically, as described above, since the respective portions or the entire portion (of a part of the apparatus body) facing the first upstream side CIS 35, the second upstream side CIS 36 and the downstream side CIS 37 are formed to have a color of the high optical absorptivity such as black. According to this configuration, when a black sheet P or a gray sheet P (hereinafter, occasionally referred to as a "non-white sheet P") is conveyed, light to be emitted from each light emitting element in the first upstream side CIS 35, the second upstream side CIS 36 and the downstream side CIS 37 has different incidence rates of the reflected light on the white sheet P from the side edge Pa as the boundary, that is, the incidence rate of the reflected light in the light receiving element is relatively low on the outer side of the sheet P and the incidence rate of the reflected light in the light receiving element is also relatively low on the inner side of the sheet P. Therefore, the overall Output waveform of the first upstream side CIS 35, the second upstream side CIS 36 and the downstream side CIS 37 becomes difficult to have a clear difference in height, and therefore the position of the side edge Pa of the sheet P cannot be detected with high accuracy. Consequently, if the black sheet P or the gray sheet P is conveyed as it is, the first upstream side CIS 35, the second upstream side CIS 36 and the downstream side CIS 37 cannot detect the attitude of the sheet in the angular direction and the width direction accurately, and therefore the angular and lateral displacements cannot be corrected with high accuracy.

Figure 10:
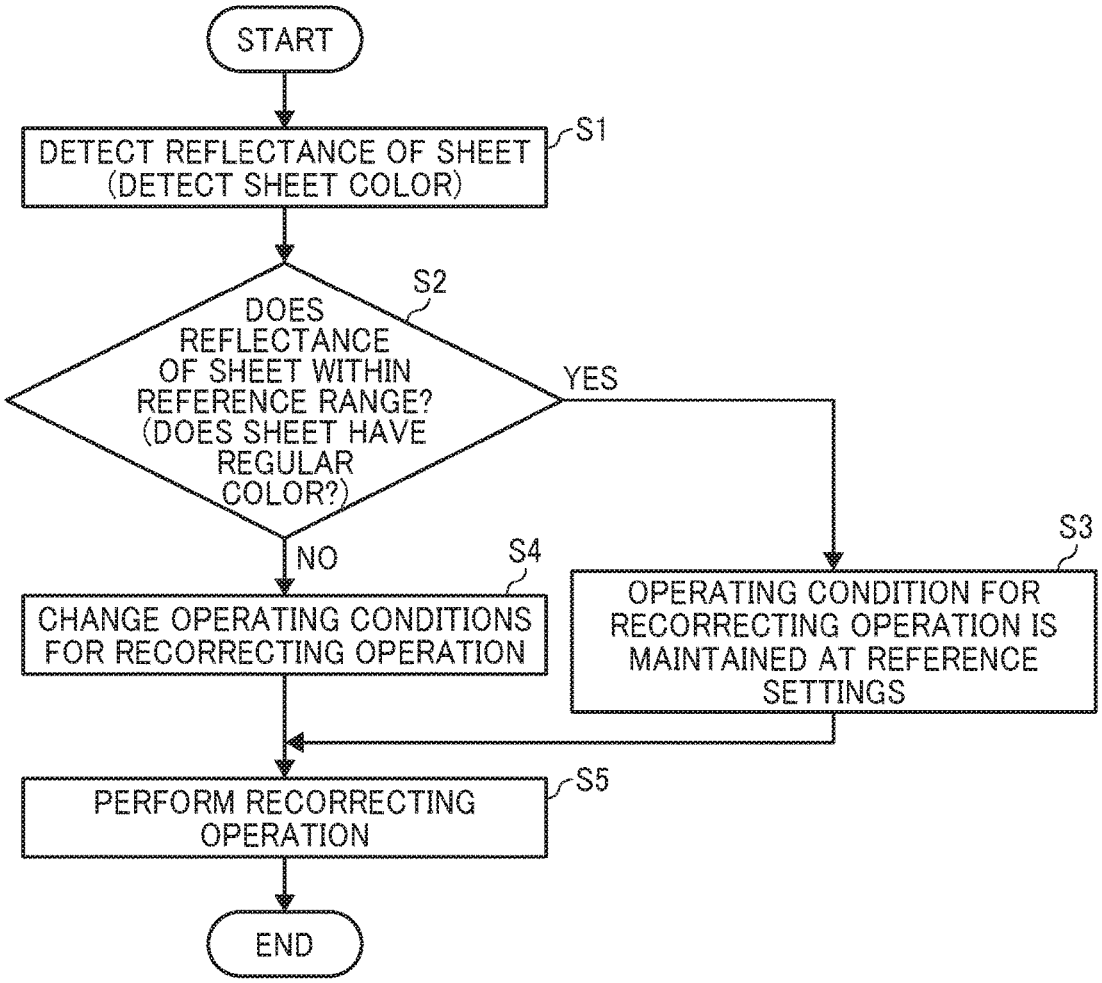
FIG. 10 is a flowchart illustrating a control procedure when performing recorrection operation processes of the sheet conveying device of this disclosure.

Therefore, in Embodiment 1, when a sheet P having reflectance (color) different from the reference color, it is controlled to change the setting (the operating condition) in the recorrection (the secondary correction) from a reference setting, that is, a setting employed when a sheet P having the reference color is conveyed, as illustrated in FIG. 10.

To be more specific, while the pair of sheet holding rollers 31 (the pair of rollers) is holding the sheet P, the controller 90 performs the correcting operations to correct the attitude of the pair of sheet holding rollers 31, by operating the second drive motor 62 (the rotation device) and the third drive motor 63 (the moving device), based on the detection results obtained by the first upstream side CIS 35, the second upstream side CIS 36 and the downstream side CIS 37 (the detectors) at predetermined time intervals T.

Consequently, the controller 90 performs the correcting operations according to the reflectance of the sheet P being conveyed, by setting at least one of light emission times of the first upstream side CIS 35, the second upstream side CIS 36 and the downstream side CIS 37 (the detectors), time intervals (recorrection intervals) for performing the correcting operations, light emission intensity of the first upstream side CIS 35, the second upstream side CIS 36 and the downstream side CIS 37, and the conveying speed of the sheet P conveyed by the pair of sheet holding rollers 31.

In Embodiment 1, before the sheet P is conveyed to the pair of sheet holding rollers 31, the controller 90 causes the second drive motor 62 (the rotation device) to drive the pair of sheet holding rollers 31 to rotate from the angular home position to correctly face the sheet P according to the angular displacement amount of the sheet P and the third drive motor 63 (the moving device) to drive the pair of sheet holding rollers 31 to move in the width direction from the lateral home position according to the lateral displacement amount of the sheet P, based on the detection results of the first upstream side CIS 35, the second upstream side CIS 36 and the downstream side CIS 37 (the detectors). Then, while the pair of sheet holding rollers 31 is holding the sheet P, the controller 90 causes the second drive motor 62 (the rotation device) to drive the pair of sheet holding rollers 31 to rotate to the angular home position to correct the angular displacement amount and the third drive motor 63 (the moving device) to drive the pair of sheet holding rollers 31 to move in the width direction to the lateral home position to correct the lateral displacement amount. Thereafter, the controller 90 repeats the correcting operations as the recorrecting operations (the secondary correction) to the extent possible.

Specifically, in Embodiment 1, the reflectance of a white sheet P having the reflectance color (which is a plain paper without any gloss) is a reference reflectance when performing the above-described control.

Then, in a case in which a sheet P having relatively small reflectance is conveyed, the controller 90 sets a longer or greater light emission time of each of the first upstream side CIS 35, the second upstream side CIS 36 and the downstream side CIS 37, when compared with a configuration in which a sheet P having relatively large reflectance is conveyed. Further, in a case in which the sheet P having relatively small reflectance is conveyed, the controller 90 sets longer or larger time intervals T (the recorrection intervals) for the correcting operations, when compared with a configuration in which the sheet P having relatively large reflectance is conveyed. Further, in a case in which the sheet P having relatively small reflectance is conveyed, the controller 90 sets greater or larger light emission intensity of the first upstream side CIS 35, the second upstream side CIS 36 and the downstream side CIS 37, when compared with a configuration in which the sheet having relatively large reflectance is conveyed. Further, in a case in which the sheet P having relatively small reflectance is conveyed, the controller 90 sets the lower or slower conveying speed of the sheet P by the pair of sheet holding rollers 31 light emission intensity of the first upstream side CIS 35, the second upstream side CIS 36 and the downstream side CIS 37, when compared with a configuration in which the sheet P having relatively large reflectance is conveyed.

Figure 11A:
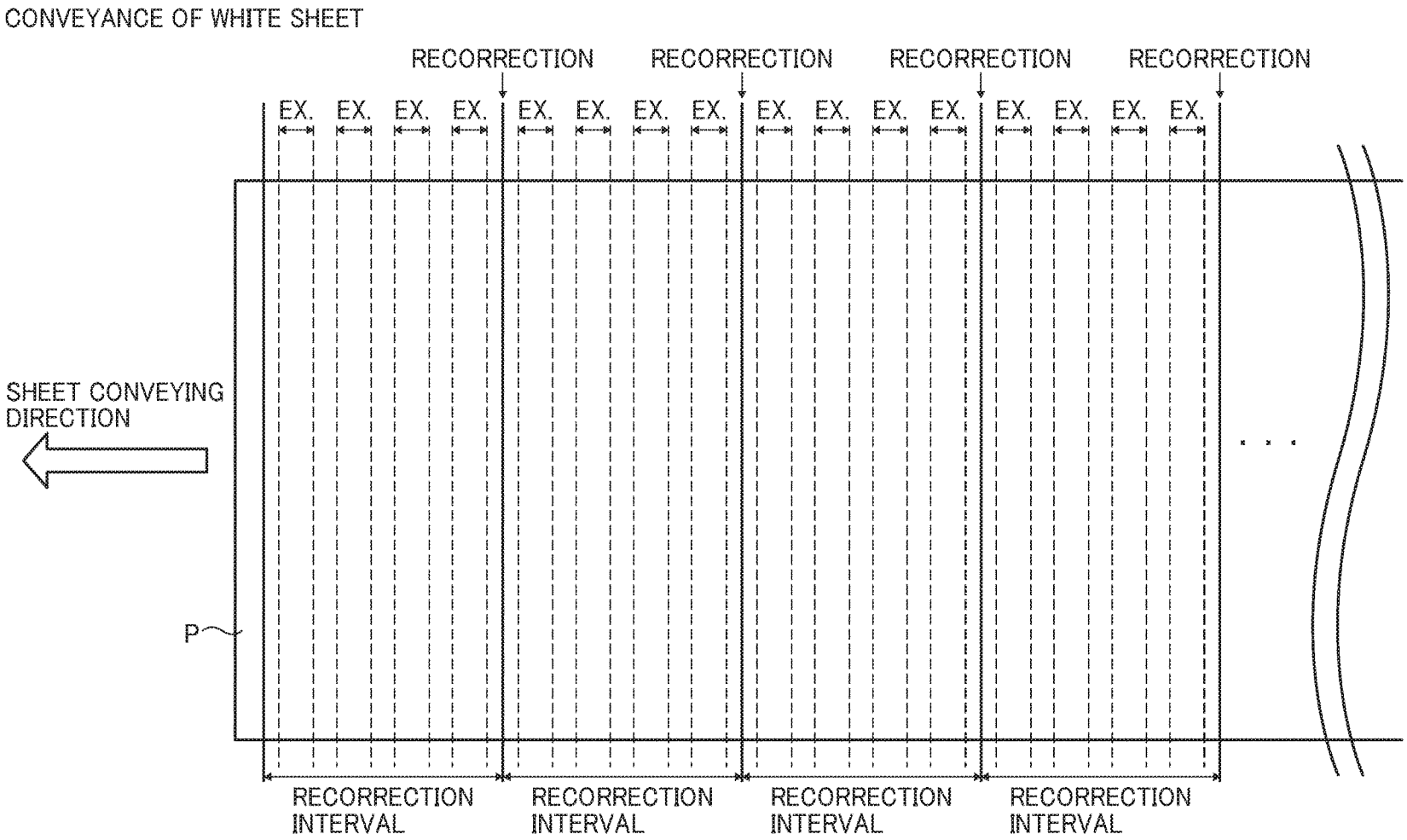
FIGS. 11A, 11B and 11C are diagrams illustrating respective states in which a setting for the recorrection operation is changed when a sheet having different reflectance (color) is conveyed.

To be more specific, referring to FIG. 11A, when a white sheet P having the reference color is conveyed, in the recorrecting operations, while the pair of sheet holding rollers 31 that functions as a pair of rollers is holding and conveying the sheet P, the controller 90 performs the recorrecting operations (the correcting operations) to correct the attitude of the pair of sheet holding rollers 31 repeatedly to the extent possible, by operating the second drive motor 62 (the rotation device) and the third drive motor 63 (the moving device), based on the detection results obtained by the second upstream side CIS 36 (a first detector) and the downstream side CIS 37 (a second detector) at predetermined time intervals (recorrection intervals).

Figure 11B:
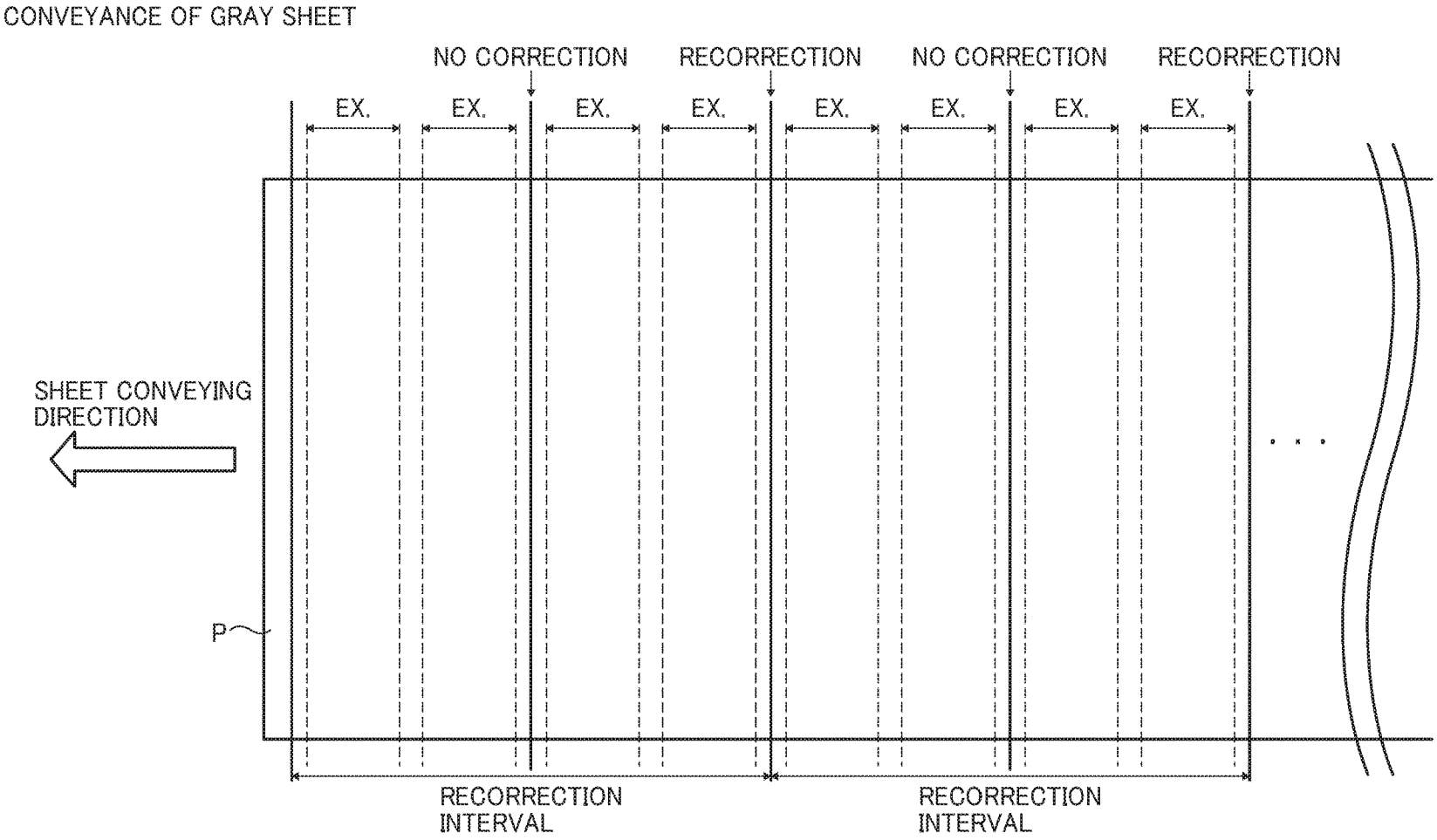
Figure 11C:
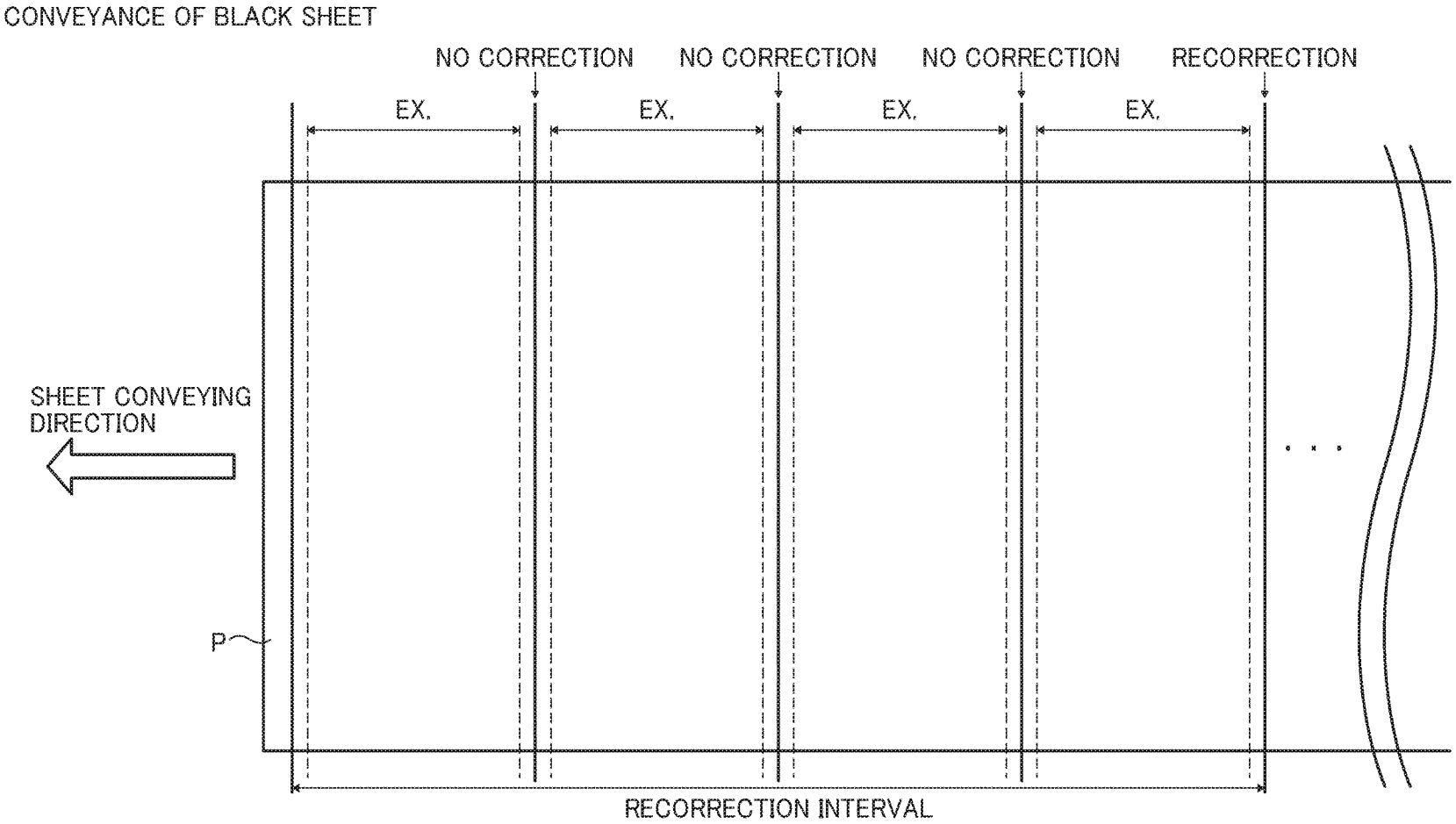
Figure 12:
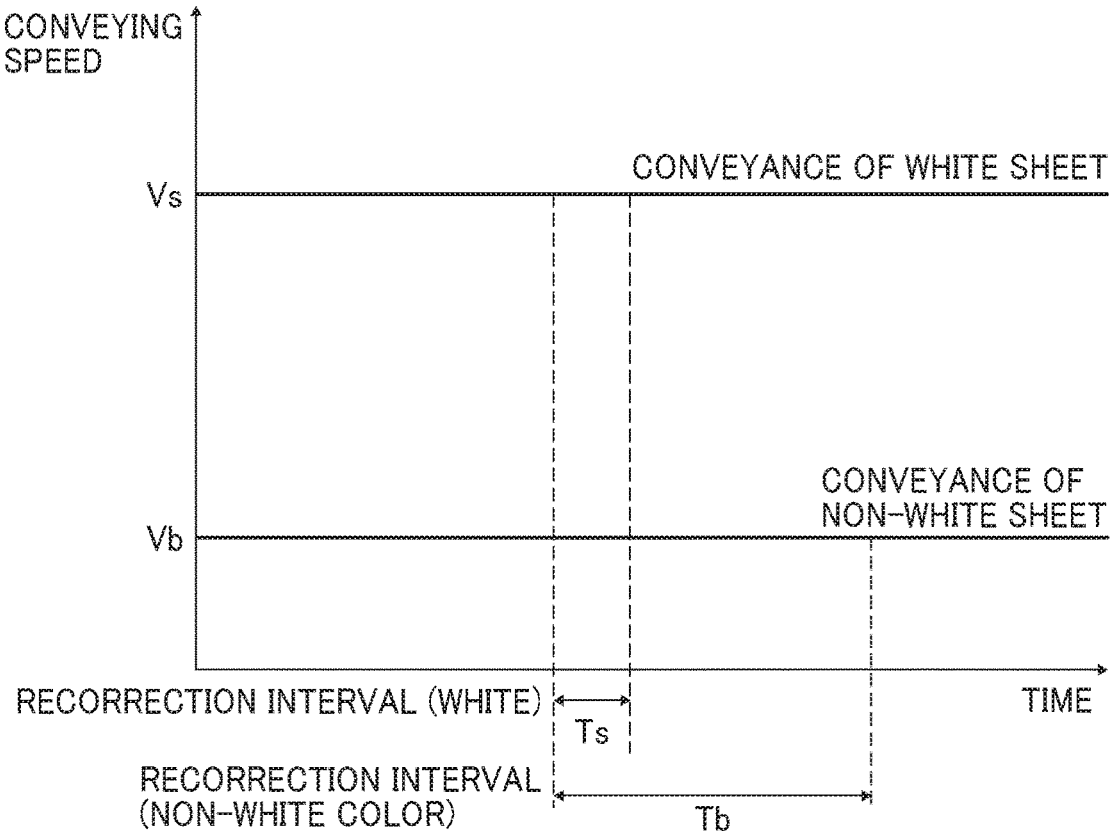
FIG. 12 is a diagram illustrating a state in which a conveying speed for the recorrection operation is changed when a sheet having different reflectance (color) is conveyed.

By contrast, referring to FIGS. 11B, 11C and 12, when a non-white sheet having a color of reflectance different from the reference color is conveyed, the controller 90 performs the recorrecting operation repeatedly to the extent possible, by changing at least one of (1) respective light emission times of the second upstream side CIS 36 (the first detector) and the downstream side CIS 37 (the second detector), (2) a time interval (recorrection interval) to perform the recorrecting operation, (3) respective light emission intensities of the second upstream side CIS 36 (the first detector) and the downstream side CIS 37 (the second detector) (light emission intensity of each light emitting element) and (4) a conveying speed of the sheet P by the pair of sheet holding rollers 31 (the number of rotations of the pair of sheet holding rollers 31).

In Embodiment 1, when a non-white sheet P having a color of reflectance smaller than a white sheet P (that is the reference color), in the recorrecting operation, according to the level of the reflectance, respective light emission times of the second upstream side CIS 36 and the downstream side CIS 37 (a light emission time per one of periodically repeated light emission) are extended longer, when compared with the light emission times of the second upstream side CIS 36 and the downstream side CIS 37 when the white sheet P of the reference color is conveyed, so as to detect the attitude of the non-white sheet P of a different color. At the same time, the time interval (the recorrection interval) to perform the recorrecting operation according to the set extended light emission time.

To be more specific, referring to FIG. 11A, when the white sheet P (the reference color sheet) is conveyed, the light emission time per light emission (EX.) of the second upstream side CIS 36 and the downstream side CIS 37 is set to be relatively short. Based on the detection results of the second upstream side CIS 36 and the downstream side CIS 37 detected at each relatively short time interval (recorrection interval) corresponding to about four times the light emission time, the recorrection of the attitude of the sheet P is performed (the second drive motor 62 and the third drive motor 63 are controlled to drive). It is to be noted that FIG. 11A illustrates the recorrection up to four times. The light emission time and time interval (recorrection interval) of the second upstream side CIS 36 and the downstream side CIS 37 described above are set as "reference settings."

By contrast, referring to FIG. 11B, when a gray sheet having reflectance smaller the white sheet P (the reference color sheet) is conveyed, the light emission time per light emission (EX.) of the second upstream side CIS 36 and the downstream side CIS 37 is set to be relatively long. Based on the detection results of the second upstream side CIS 36 and the downstream side CIS 37 detected at each relatively short time interval (recorrection interval) corresponding to about four times the light emission time, the recorrection of the attitude of the sheet P is performed (the second drive motor 62 and the third drive motor 63 are controlled to drive). It is to be noted that FIG. 11B illustrates the recorrection up to two times at the same time interval as FIG. 11A.

Further, referring to FIG. 11C, when a black sheet P having reflectance smaller the gray sheet P is conveyed, the light emission time per light emission (EX.) of the second upstream side CIS 36 and the downstream side CIS 37 is set to be longer. Based on the detection results of the second upstream side CIS 36 and the downstream side CIS 37 detected at each relatively short time interval (recorrection interval) corresponding to about four times the light emission time, the recorrection of the attitude of the sheet P is performed (the second drive motor 62 and the third drive motor 63 are controlled to drive). It is to be noted that FIG. 11C illustrates the recorrection up to one time at the same time interval as FIGS. 11A and 11B.

As described above, the light emission times of the second upstream side CIS 36 and the downstream side CIS 37 are set to be sufficiently long and the time interval (the recorrection interval) to perform the recorrecting operation is extended along with the setting of the light emission times. By so doing, even when the reflectance of the sheet P is relatively small, in the overall output waveforms of the first upstream side CIS 35, the second upstream side CIS 36 and the downstream side CIS 37, the difference in height is easily determined at the position corresponding to the lateral end face Pa as the boundary. Therefore, the position of the lateral end face Pa of the sheet P having relatively small reflectance is detected with relatively high accuracy, and the time taken for each recorrecting operation according to the extended detection time. Accordingly, even though the number of repeats of the recorrecting operation is reduced, the overall attitude of the non-white sheet P having a color different from the reference color in the angular direction and the width direction is corrected with relatively high accuracy.

It is to be noted that FIGS. 11A through 11C illustrate respective sheets P having different colors as respective setting changes of the recorrecting operation to a sheet P having different reflectance. However, the change of setting of the recorrecting operation to the sheet P having different reflectance is performed as long as the sheet P has the same color and different reflectance (for example, a plain paper and a gross paper). As a specific control, as described below with reference to FIG. 10, the reflectance of the sheet P is directly detected by the detector. Based on the detection result, in a case in which the reflectance is within a predetermined reference range, the recorrecting operation is performed with the reference settings. By contrast, in a case in which the reflectance is out of the predetermined reference range, the recorrecting operation is performed after changing the reference settings according to the reflectance.

Further, in Embodiment 1, when a non-white sheet P having a different color of reflectance smaller than a white sheet P (the reference color), in the recorrecting operation, according to the level of the reflectance, respective light emission intensities of (respective light emitting elements of) the second upstream side CIS 36 and the downstream side CIS 37 are set greater, when compared with the light emission intensities of (the respective light emitting elements of) the second upstream side CIS 36 and the downstream side CIS 37 when the sheet P of the reference color is conveyed.

Specifically, in a case in which a gray sheet P is conveyed, the controller 90 adjusts the light amounts of the second upstream side CIS 36 and the downstream side CIS 37, so that the light emission intensities of the second upstream side CIS 36 and the downstream side CIS 37 are set to be greater than the light emission intensities when a white sheet P (the reference color) is conveyed. Further, in a case in which a black sheet P is conveyed, the controller 90 adjusts the light amounts of the second upstream side CIS 36 and the downstream side CIS 37, so that the light emission intensities of the second upstream side CIS 36 and the downstream side CIS 37 are set to be further greater than the light emission intensities when a gray sheet P is conveyed.

As described above, the light emission intensities of the second upstream side CIS 36 and the downstream side CIS 37 are set to be sufficiently great. By so doing, even when the reflectance of the sheet P is relatively small, in the overall output waveforms of the first upstream side CIS 35, the second upstream side CIS 36 and the downstream side CIS 37, the difference in height is easily generated at the position corresponding to the lateral end face Pa as the boundary. Therefore, the position of the lateral end face Pa of the sheet P having relatively small reflectance is detected with relatively high accuracy, and the attitude of the non-white sheet P having a color different from the reference color in the angular direction and the width direction is corrected with relatively high accuracy.

Further, in Embodiment 1, when a non-white sheet P having a color of reflectance smaller than a white sheet P that is the reference color, in the recorrecting operation, according to the level of the reflectance, the conveying speed of the sheet P by the pair of sheet holding rollers 31 (the number of rotations of the pair of sheet holding rollers 31) is set slower, when compared with the conveying speed of the sheet P by the pair of sheet holding rollers 31 when the sheet P of the reference color is conveyed, so that the time interval (the recorrection interval) to perform the recorrecting operation is extended (longer) according to the set conveying speed of the sheet P by the pair of sheet holding rollers 31.

Specifically, referring to FIG. 12, in a case in which a white sheet P (the reference color) is conveyed, the first drive motor 59 is controlled to drive such that the conveying speed of the sheet P by the pair of sheet holding rollers 31 is set to be a conveying speed Vs. Then, while the pair of sheet holding rollers 31 is holding and conveying the white sheet P at the conveying speed Vs in the reference settings, the recorrecting operation is repeated at a time interval Ts (the recorrection interval) in the reference settings.

By contrast, in a case in which a non-white sheet P having relatively smaller reflectance is conveyed, the first drive motor 59 is controlled to drive such that the conveying speed of the sheet P by the pair of sheet holding rollers 31 is set to be a conveying speed Vb that is smaller than the conveying speed Vs in the reference settings (Vb<Vs). Then, while the pair of sheet holding rollers 31 is holding and conveying the non-white sheet P at the conveying speed Vb slower than the conveying speed Vs, the recorrecting operation is repeated at a time interval Tb (the recorrection interval) that is longer than the time interval Ts in the reference settings.

As described above, the conveying speed of the sheet P by the pair of sheet holding rollers 31 is set to be sufficiently slow and the time interval (the recorrection interval) to perform the recorrecting operation is extended along with the setting of the conveying speed of the sheet P. By so doing, even when the reflectance of the sheet P is relatively small, in the overall output waveforms of the first upstream side CIS 35, the second upstream side CIS 36 and the downstream side CIS 37, the difference in height is easily determined at the position corresponding to the lateral end face Pa as the boundary. Therefore, the position of the lateral end face Pa of the sheet P having relatively small reflectance is detected with relatively high accuracy, and the time taken for each recorrecting operation according to the extended detection time. Accordingly, even though the number of repeats of the recorrecting operation is reduced, the overall attitude of the non-white sheet P having a color different from the reference color in the angular direction and the width direction is corrected with relatively high accuracy.

Here, in a relation of the conveying speed Vs in the reference settings, the time interval Ts in the reference settings, the conveying speed Vb for conveying a non-white color sheet and the time interval Tb for conveying a non-white color sheet, in a case in which the time interval Tb (the correction interval) for conveying a non-white color sheet is previously determined, in addition to the reference setting parameters, the conveying speed Vs and the time interval Ts, the conveying speed Vb for conveying the non-white color sheet is calculated to meet the following relation:

$$Vs \times Ts == Vb \times Tb.$$

With this relation, the above-described recorrecting operation is performed smoothly in the sheet conveyance passage having a certain distance.

Further, in the above-described case, due to the difference of the time interval of the gray sheet P and the time interval of the black sheet P described with reference to FIGS. 11B and 11C, when compared with a conveying speed Vb1 for conveying the gray sheet P, a conveying speed Vb2 for conveying the black sheet P is set to be slower (Vb1>Vb2).

Here, the controller 90 performs the correcting operation repeatedly until immediately before the corrected sheet P reaches the position (the transfer nip region) of the transfer roller 7 (the pair of downstream side sheet conveying rollers). That is, the controller 90 performs the recorrecting operation repeatedly within a "possible range" that is a range until immediately before the corrected sheet P reaches the position (the transfer nip region) of the transfer roller 7 (the pair of downstream side sheet conveying rollers), under the operating conditions of each color of the above-described sheets P. To be more specific, the "recorrection (the primary correction)" is performed repeatedly to the extent possible, according to the set time interval (the recorrection interval), from a time at which the pair of sheet holding rollers 31 is returned to the lateral home position and the angular home position (the primary correction is completed) as described with reference to FIGS. 9A and 9B to a time at which the leading end of the sheet P reaches the transfer nip region.

For example, assuming that a period of time from the start of the secondary correction to the arrival of the leading end of the sheet P to the transfer nip region is 100, if the time interval (the recorrection interval) is 20, the recorrecting operation is repeated for five (5) times. By contrast, if the time interval (the recorrection interval) is 50, the recorrecting operation is repeated for two (2) times.

Here, in Embodiment 1, the reflectance of the sheet P being conveyed is detected by the detectors (i.e., at least one of the first upstream side CIS 35 and the second upstream side CIS 36 in Embodiment 1). Then, based on the detection results, the controller 90 changes the setting in the recorrecting operation (the recorrecting operation).

For example, assuming a plain paper is conveyed as a sheet P, whether the color of the sheet P being conveyed is the reference color (i.e., white) or a different color is detected by the first detector (i.e., at least one of the first upstream side CIS 35 and the second upstream side CIS 36). Then, based on the detection result, the controller 90 controls to change the setting (the operating condition) in the above-described recorrecting operation.

To be more specific, in Embodiment 1, the first upstream side CIS 35 disposed at an extreme upstream side in the sheet conveying direction is regarded as the first detector to detect the color of the sheet P being conveyed in advance. According to the level of an output value on the sheet side where the side end face Pa of the sheet P to be detected by the first upstream side CIS 35, the reflectance of the sheet P is detected (i.e., the color is detected indirectly).

It is to be noted that in Embodiment 1, the reflectance (color) of the sheet P being detected is detected by the first detector (i.e., the first upstream side CIS 35). However, the reflectance (color) of the sheet P being detected may be detected based on information input via the control panel 100 by a user.

That is, in this case, the reflectance of the sheet P being conveyed is detected based on information input via the control panel 100 by a user, and the controller 90 changes the setting in the correcting operation based on the detection result. Assuming that a plain paper is conveyed as a sheet P, whether the color of the sheet P being conveyed is the reference color (i.e., white) or a different color is detected based on the information input by a user. Then, based on the detection result, the controller 90 controls to change the setting (the operating condition) in the recorrecting operation.

To be more specific, a user inputs information of the sheet P that is set a selected one of the first sheet feeding unit 12, the second sheet feeding unit 13 and the third sheet feeding unit 14, via the control panel 100 (see FIG. 1) disposed on an exterior of the image forming apparatus 1. The information input by the user includes information of the reflectance of the sheet P (for example, the gross level of the surface of the sheet P and the color of the sheet P) in addition to information of the size of the sheet P. As the information is inputted via the control panel 100, the controller 90 detects (grasps) the information of the color.

Now, a brief description is given of the control flow in the recorrection 8 the secondary correction), with reference to the flowchart of FIG. 10. It is to be noted that the operations written within the parenthesis in steps S1 and S2 of FIG. 10 are described about an indirect detection when sheets P having the substantially same gross level of each surface thereof (for example, plain papers) are conveyed.

As illustrated in FIG. 10, as the sheet P reaches the position of the first upstream side CIS 35, the reflectance of the sheet P is detected by the first upstream side CIS 35 (the first detector), in step S1.

Then, it is determined whether the detected reflectance of the sheet P is within the predetermined reference range, in step S2. As a result, when it is determined that the reflectance of the sheet P is within the predetermined reference range (YES in step S2), the operating conditions for the recorrecting operation (i.e., the light emission time, the time interval, the light emission intensity and the conveying speed) are not changed from the reference settings, in step S3. Then, the recorrecting operation is repeated to the extent possible with the reference settings, in step S5.

By contrast, when it is determined that the reflectance of the sheet P is out of the predetermined reference range (NO in step S2) (in other words, when the sheet P is a non-white sheet), the operating conditions for the recorrecting operation (i.e., the light emission time, the time interval, the light emission intensity and the conveying speed) are changed from the reference settings, in step S4. Then, the recorrecting operation is repeated to the extent possible with the changed settings, in step S5.

It is to be noted that, in Embodiment 1, the settings (the operating conditions) in the recorrecting operation is controlled to be changed while the regular sheet conveyance processes (the image forming processes) is performed. However, the timing of the operation is not limited thereto. For example, the settings (the operating conditions) may be controlled to change while the regular sheet conveyance processes (the image forming processes) is not performed. At that time, the controller 90 changes the settings in the correcting operation at a time when the regular sheet conveyance processes is not performed, as described above.

To be more specific, a user or a service representative operates the control panel 100 to control to change the settings in the recorrecting operation as a test control (hereinafter, an "adjustment mode"), apart from the regular image forming operations (the printing operations).

Figure 13:
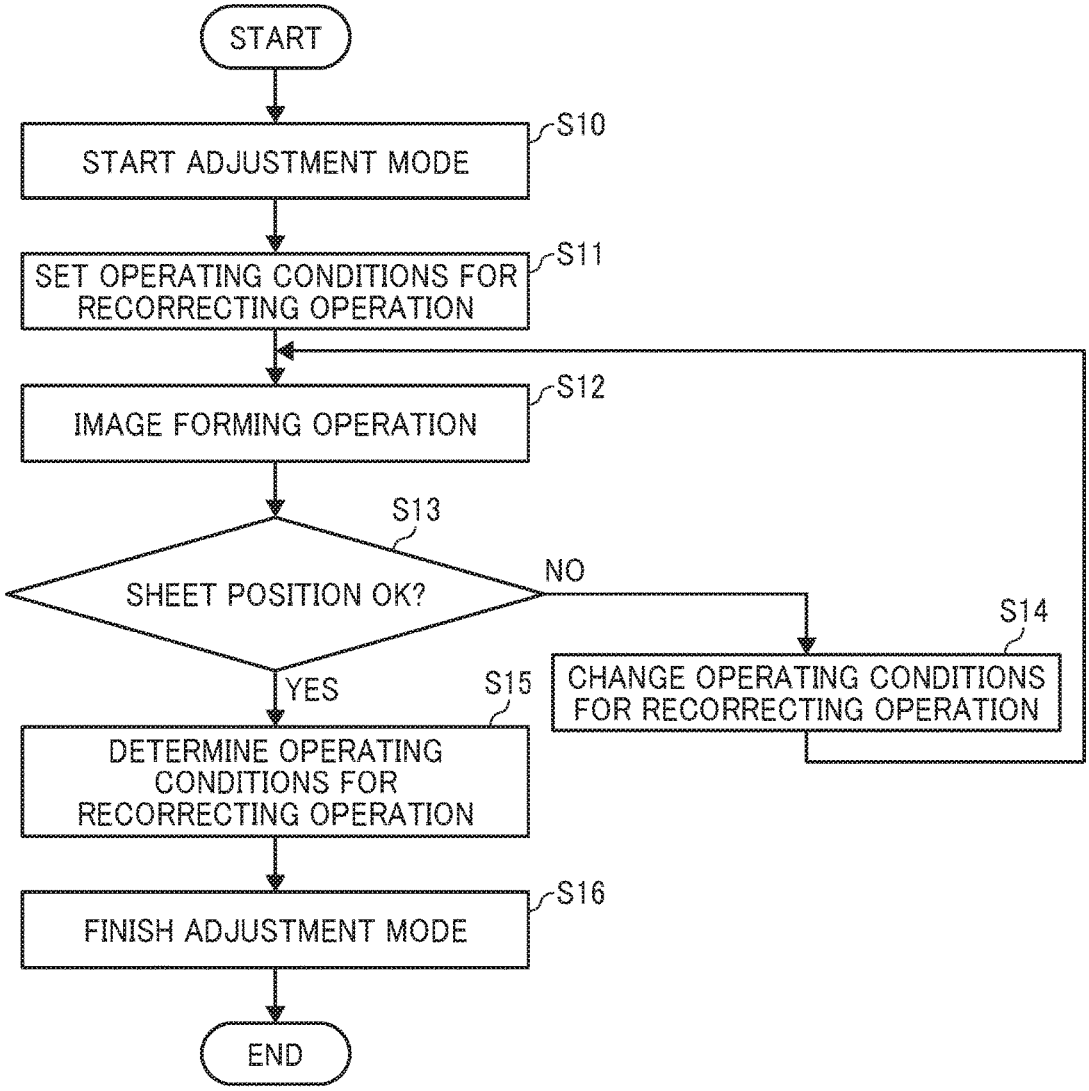
FIG. 13 is a flowchart of control in an adjustment mode.

To be more specific, as illustrated in the flowchart of FIG. 13, as the control panel 100 is operated by a user to select the "adjustment mode", an instruction is displayed to set a sheet P having reflectance different from the reflectance of the sheet P within the reference range (i.e., a sheet P having different reflectance the user wishes to use) in a selected sheet feeding unit. Then, after the desired sheet P having the different reflectance is set in the selected sheet feeding unit, the adjustment mode is started, in step S10. Consequently, based on the reflectance information of the sheet P set in the selected sheet feeding unit, the standard operating conditions (the light emission time, the time interval, the light emission intensity and the conveying speed) for the recorrecting operation with respect to the reflectance are set, in step S11.

Then, the sheet P having the different reflectance set in the selected sheet feeding unit is conveyed, and the image formation onto the conveyed sheet P is performed, similar to the regular image forming operations, in step S12. At this time, an image formed on the sheet P is a test image for visualizing the amount (level) of angular and lateral displacements generated on the sheet P. Then, the user or the service representative checks the test image on the output sheet P and examines the angular and lateral displacements generated on the sheet P. Then, the test result is input via the control panel 100 (by pressing the OK button or the NG button). According to the input of the test result, it is determined whether the attitude of the sheet P having the different reflectance (i.e., the angular displacement and the lateral displacement) is good or not good, in step S13.

As a result, when it is determined that the attitude of the sheet P having the different reflectance is good (YES in step S13), the operating conditions set in step S11 are determined as the operating conditions for the sheet P having the different reflectance, in step S15. Accordingly, the adjustment mode is finished, in step S16. In a case in which a subsequent sheet P having the same reflectance as that of the sheet P that has been conveyed in the adjustment mode is used in subsequent regular image forming operations, the recorrecting operation is performed under the operating conditions determined in step S15.

By contrast, when it is determined that the attitude of the sheet having the different reflectance is not good (NO in step S13), the operating conditions set in step S11 are changed, in step S14, and the procedure goes back to step S12 to repeat the flow. Then, the operating conditions when the attitude of the sheet P having the different reflectance becomes good are determined as the operating conditions for the sheet P having the different reflectance, in step S15, and the adjustment mode is finished, in step S16. In a case in which a subsequent sheet P having the same reflectance as that of the sheet P that has been conveyed in the adjustment mode is used in subsequent regular image forming operations, the recorrecting operation is performed under the operating conditions determined in step S15.

When the "adjustment mode" is executed as described above, a finely tuned setting can be made according to a non-white color sheet having different reflectance.

As described above, the sheet conveying device 30 of the image forming apparatus 1 according to Embodiment 1 includes the first upstream side CIS 35, the second upstream side CIS 36 and the downstream side CIS 37 (the detectors) to optically detect the attitude of the sheet P in the sheet conveyance passage, and the controller 90 to perform the recorrecting operations (the correcting operations) to correct the attitude of the pair of sheet holding rollers 31 by operating the second drive motor 62 (the rotation device) and the third drive motor 63 (the moving device) based on the detection results of the first upstream side CIS 35, the second upstream side CIS 36 and the downstream side CIS 37 at predetermined time intervals while the pair of sheet holding rollers 31 (the pair of rollers) is holding the sheet P. Consequently, the controller 90 performs the recorrecting operations (the correcting operations) according to the reflectance of the sheet P being conveyed, by setting at least one of light emission times of the first upstream side CIS 35, the second upstream side CIS 36 and the downstream side CIS 37, time intervals (recorrection intervals) for performing the recorrecting operations (the correcting operations), light emission intensity of the first upstream side CIS 35, the second upstream side CIS 36 and the downstream side CIS 37, and the conveying speed of the sheet P conveyed by the pair of sheet holding rollers 31.

According to this configuration, the sheet conveying device 30 corrects the attitude of the sheet P with high accuracy, regardless of reflectance of the sheet P being conveyed.

Further, in Embodiment 1, this disclosure is applied to the sheet conveying device 30 in which the pair of sheet holding rollers 31 that functions as a pair of lateral and angular displacement correction rollers also functions as a pair of registration rollers. However, the configuration of a sheet conveying device to which this disclosure is applied is not limited thereto. This disclosure may be applied to a sheet conveying device having a different configuration. For example, this disclosure may be applied to a sheet conveying device having a pair of registration rollers disposed downstream from the pair of sheet holding rollers 31 that functions as a pair of lateral and angular displacement correction rollers in the sheet conveying direction naturally.

Further, in Embodiment 1, this disclosure is applied to the sheet conveying device 30 in which the angular and lateral displacement corrections of a transfer sheet as a sheet P on which an image is formed. However, the configuration of a sheet conveying device to which this disclosure is applied is not limited thereto. For example, this disclosure may be applied naturally to a sheet conveying device that performs the angular and lateral displacement corrections of an original document as a sheet P.

Further, in Embodiment 1, this disclosure is applied to the sheet conveying device 30 that is included in the image forming apparatus 1 that performs monochrome image formation. However, the configuration of an image forming apparatus to which this disclosure is applied is not limited thereto. For example, this disclosure may be applied naturally to a sheet conveying device that is included in a color image forming apparatus.

Further, in Embodiment 1, this disclosure is applied to the sheet conveying device 30 in which the angular displacement and the lateral displacement of the sheet P being conveyed are corrected. However, the configuration of a sheet conveying device to which this disclosure is applied is not limited thereto. This disclosure may be applied to a sheet conveying device having a configuration in which either one of the angular displacement and the lateral displacement of a sheet being conveyed is corrected.

Further, in Embodiment 1, the detector that optically detects the attitude of the sheet P in the sheet conveyance passage includes the first detector (i.e., the first upstream side CIS 35 and the second upstream side CIS 36) and the second detector (i.e., the downstream side CIS 37). However, the configuration of the detector is not limited thereto and may be any of other various configurations.

Further, in Embodiment 1, the settings (the operating conditions) of the correcting operation is changed according to reflectance of a sheet P in the secondary correction (the recorrection). However, the configuration of the sheet conveying device 30 is not limited thereto. For example, the settings (the operating conditions) of the correcting operation is changed according to reflectance of a sheet P in the primary correction or in both the primary correction and the secondary correction.

Further, even if any of the above-described configurations of the sheet conveying device 30 is employed, the same effect as in Embodiment 1 can be achieved.

Embodiment 2

Figure 15A:
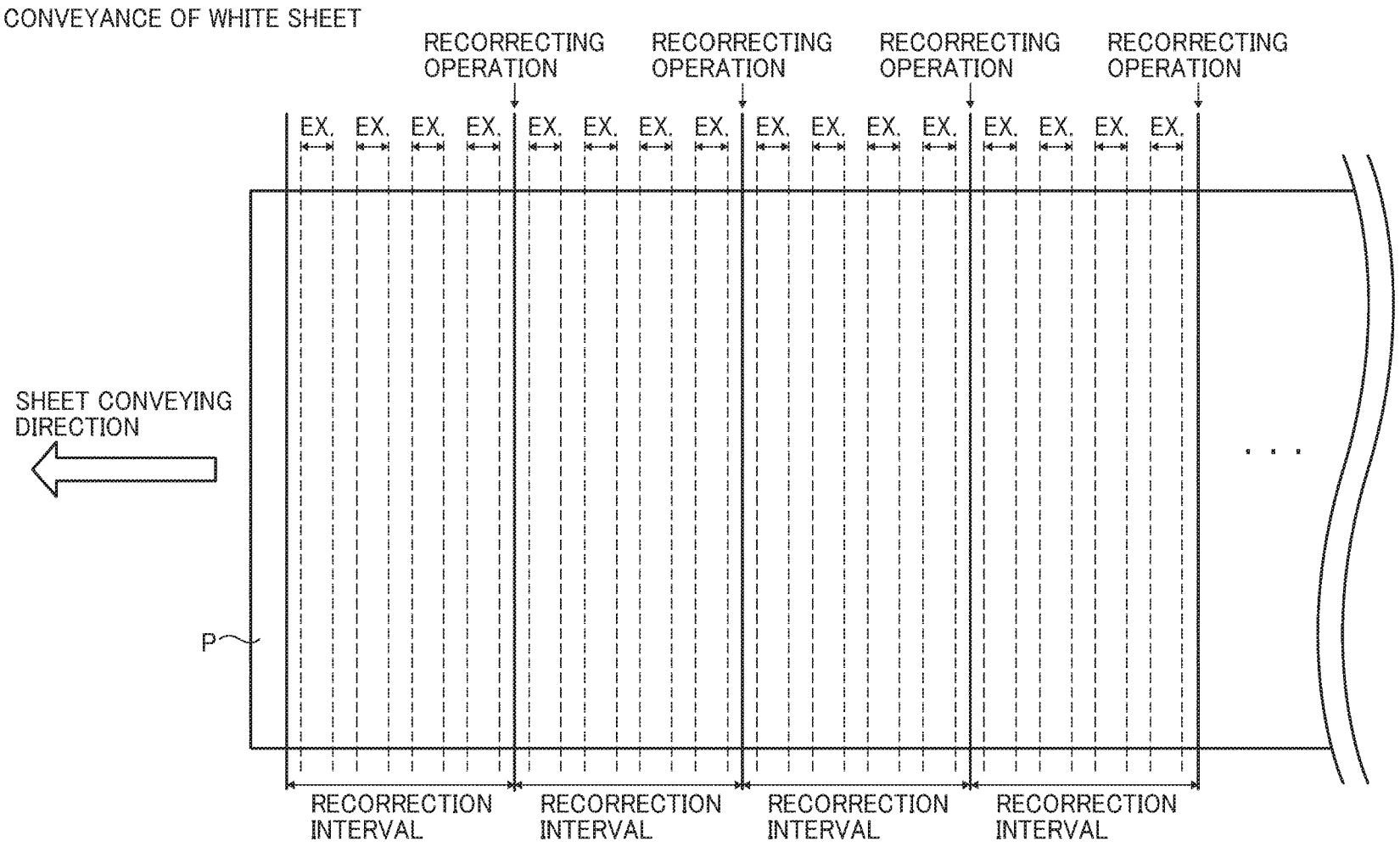
FIGS. 15A, 15B and 15C are diagrams illustrating respective states in which a setting for the recorrection operation is changed when a sheet having different reflectance (color) is conveyed in a sheet conveying device according to Embodiment 2 of this disclosure.
Figure 15B:
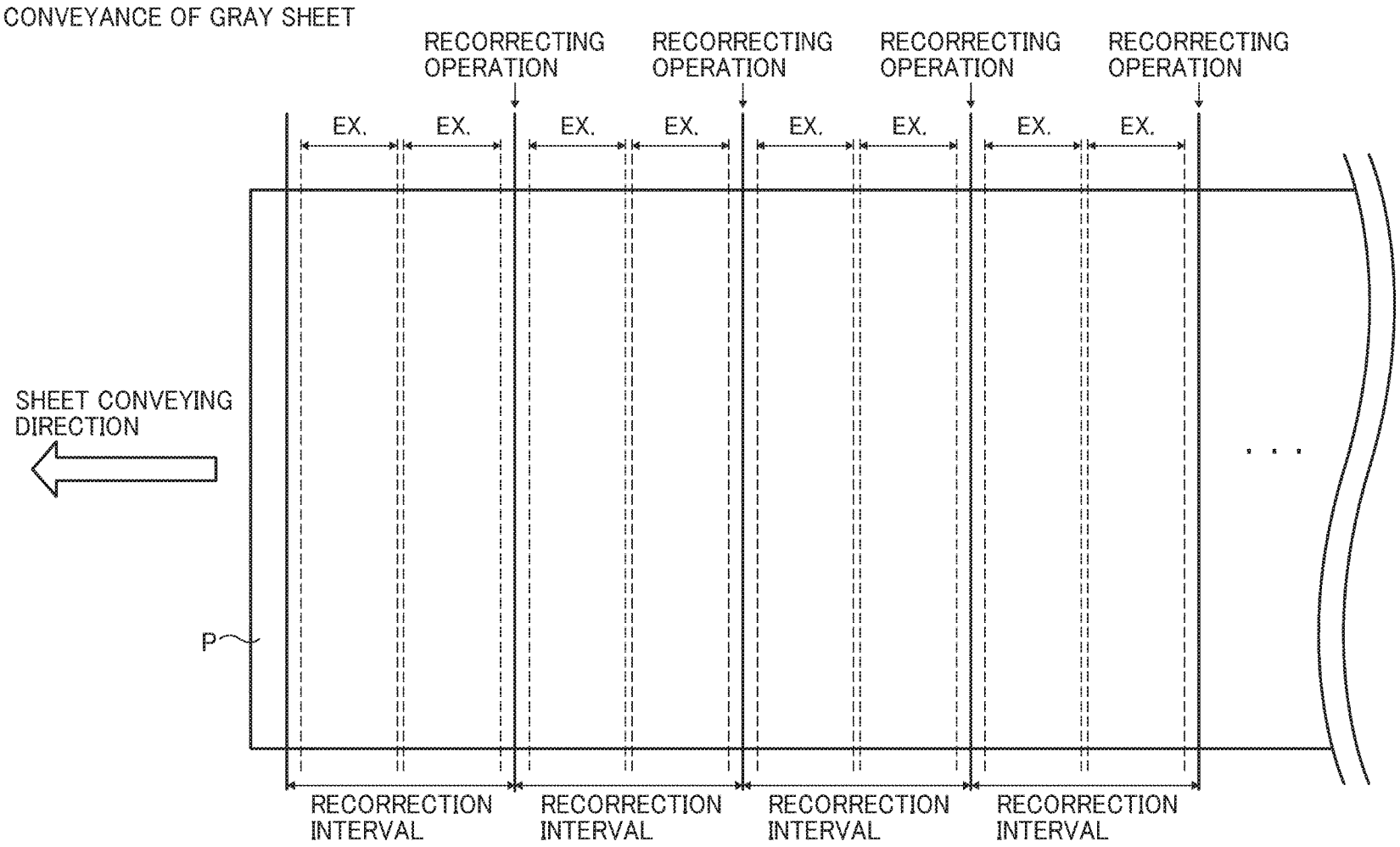
Figure 15C:
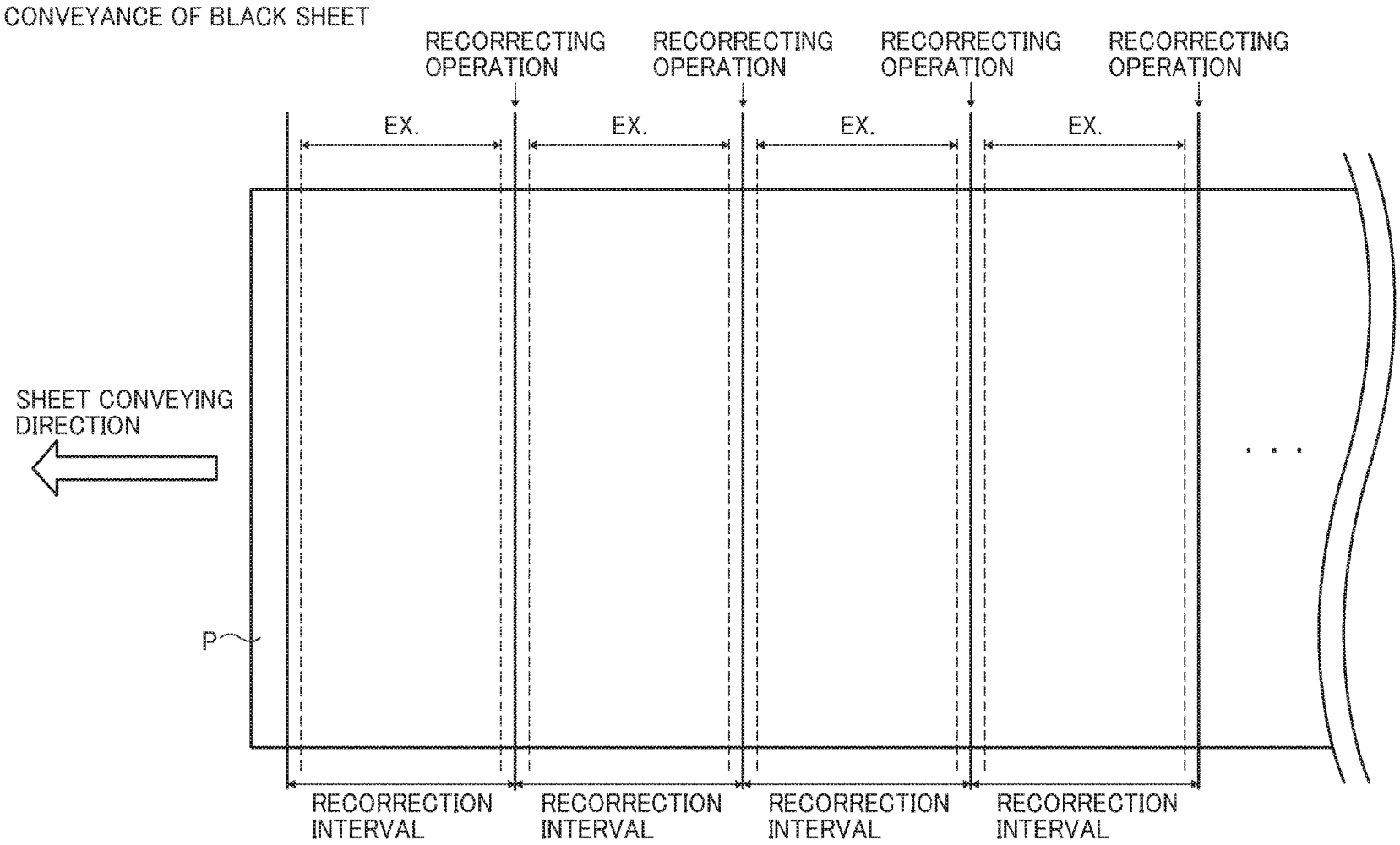

Next, a description is given of a configuration and functions of the sheet conveying device 30 and an image forming apparatus 1, according to Embodiment 2 of this disclosure, with reference to FIGS. 15A, 15B and 15C.

FIGS. 15A, 15B and 15C are diagrams illustrating respective states in which the settings (the operating conditions) for the recorrecting operation is changed when a sheet P having different reflectance (color) is conveyed in a sheet conveying device according to Embodiment 2 of this disclosure. The configuration illustrated in FIGS. 15A, 15B and 15C according to Embodiment 2 corresponds to the configuration illustrated in FIGS. 11A, 11B and 11C according to Embodiment 1.

The configuration of the sheet conveying device 30 according to Embodiment 2 is basically identical to the configuration of the sheet conveying device 30 according to Embodiment 1, except that, while Embodiment 1 has the configuration in which the light emission times of the second upstream side CIS 36 and the downstream side CIS 37 and the time interval for the recorrecting operation (the recorrection interval) are changed according to the reflectance of the sheet P, Embodiment 2 has the configuration in which the light emission times of the second upstream side CIS 36 and the downstream side CIS 37 alone are changed according to the reflectance of the sheet P.

To be more specific, referring to FIG. 151, in Embodiment 2, when the white sheet P (the reference color sheet) is conveyed (in the reference settings), the light emission time per light emission (EX.) of the second upstream side CIS 36 and the downstream side CIS 37 is set to be relatively short. Based on the detection results of the second upstream side CIS 36 and the downstream side CIS 37 detected at each relatively short time interval (the recorrection interval) corresponding to about four times the light emission time, the recorrection of the attitude of the sheet P is performed (the second drive motor 62 and the third drive motor 63 are controlled to drive).

Further, referring to FIG. 15B, when a gray sheet P having reflectance smaller the white sheet P (the reference color sheet P) is conveyed, the light emission time per light emission (EX.) of the second upstream side CIS 36 and the downstream side CIS 37 is set to be longer than the light emission time of the reference settings. Based on the detection results of the second upstream side CIS 36 and the downstream side CIS 37 detected and acquired at each relatively short time interval (the recorrection interval corresponding to about two times the light emission time) that is the same time interval in the reference settings, the recorrection of the attitude of the sheet P is performed.

Further, referring to FIG. 15C, when a black sheet P having reflectance smaller the gray sheet P is conveyed, the light emission time per light emission (EX.) of the second upstream side CIS 36 and the downstream side CIS 37 is set to be further longer than the light emission time when the gray sheet is conveyed. Based on the detection results of the second upstream side CIS 36 and the downstream side CIS 37 detected and acquired at each of the same interval in the reference settings (the recorrection interval corresponding to the light emission time), the recorrection of the attitude of the sheet P is performed.

Even when the above-described control is performed, the above-described configuration can achieve the substantially same effect as each configuration of the sheet conveying device 30 according to Embodiment 1.

Figure 16A:
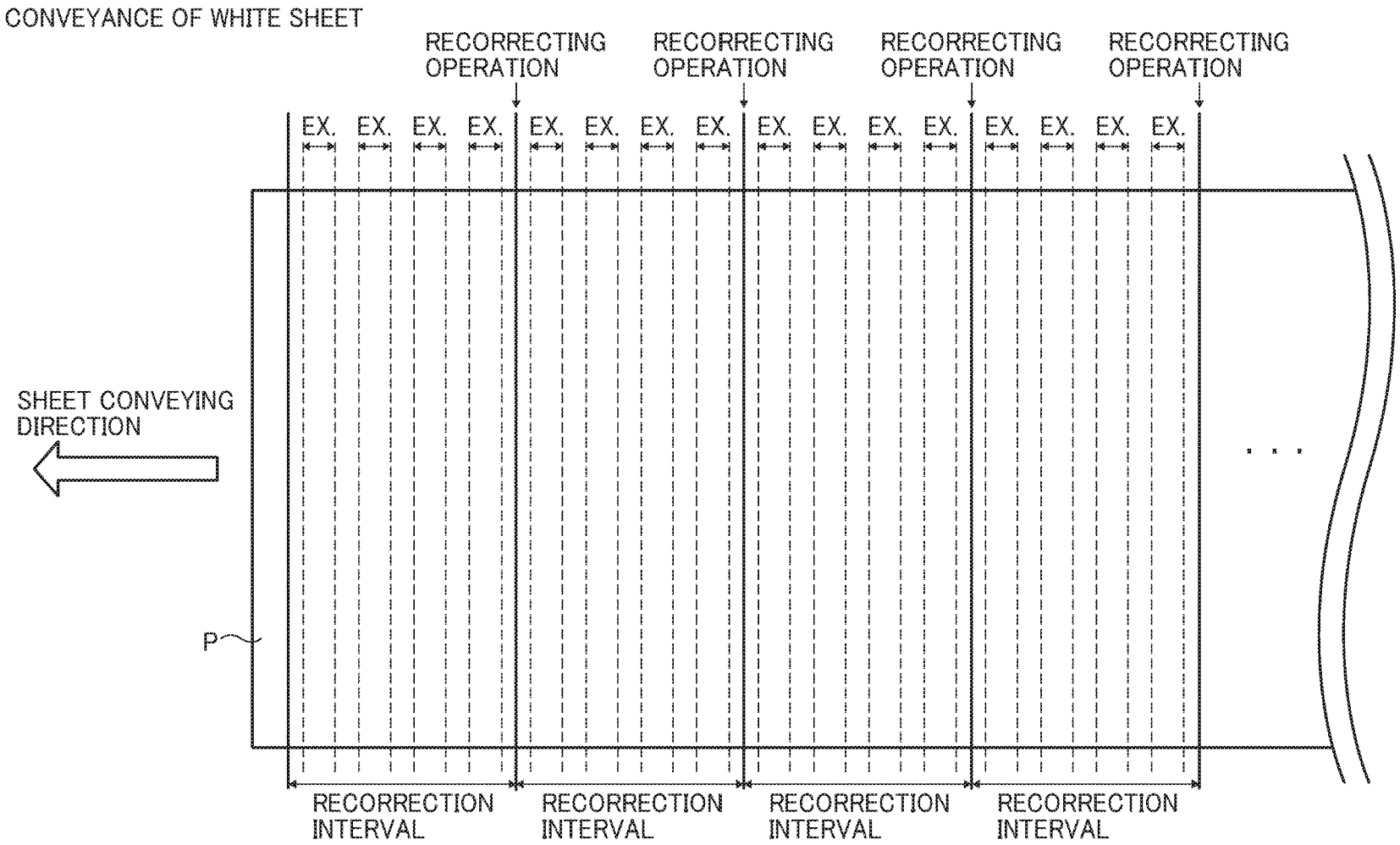
FIGS. 16A, 16B and 16C are diagrams illustrating respective states in which a setting for the recorrection operation is changed when a sheet having different reflectance (color) is conveyed in the sheet conveying device according to Variation of this disclosure.
Figure 16B:
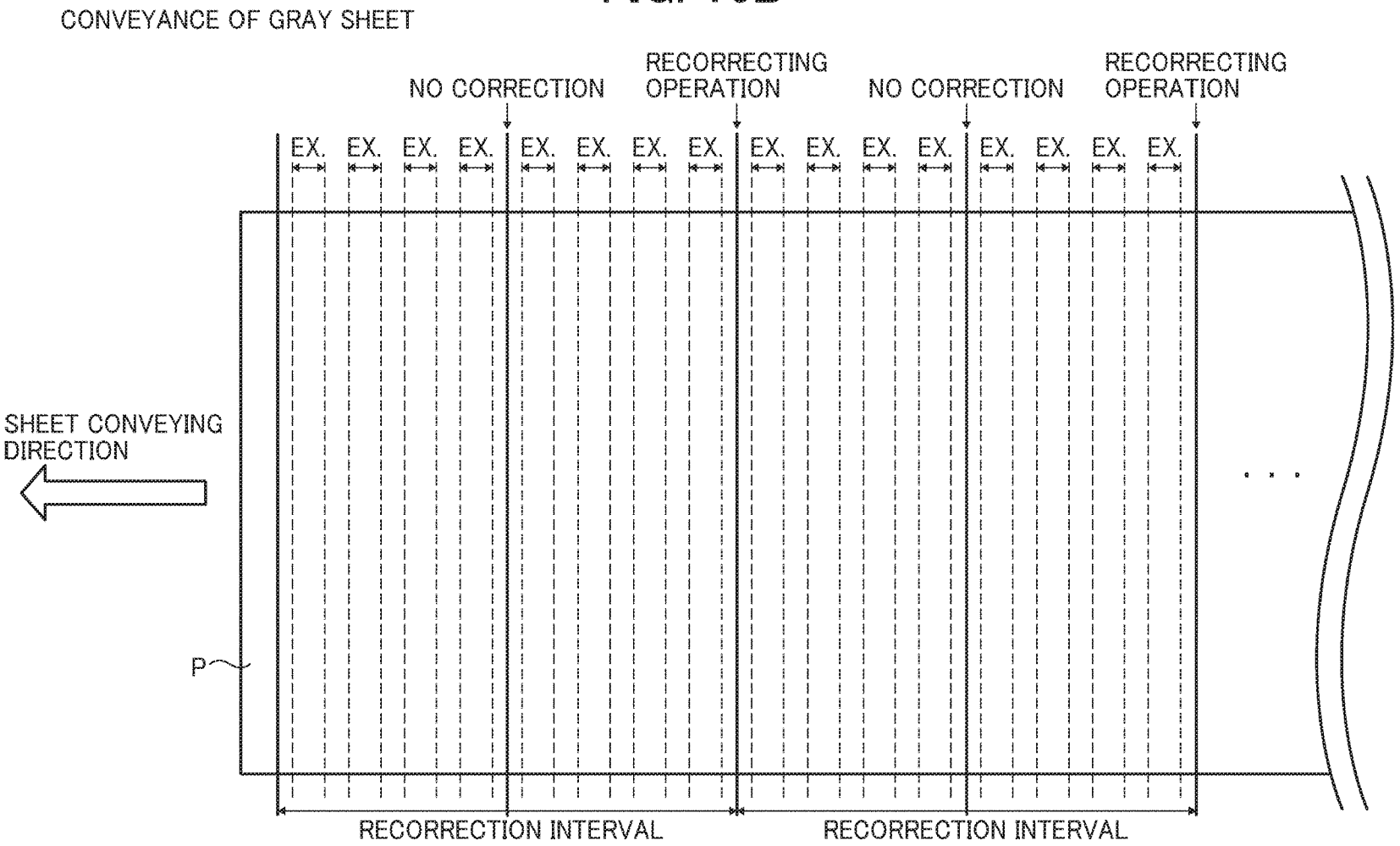
Figure 16C:
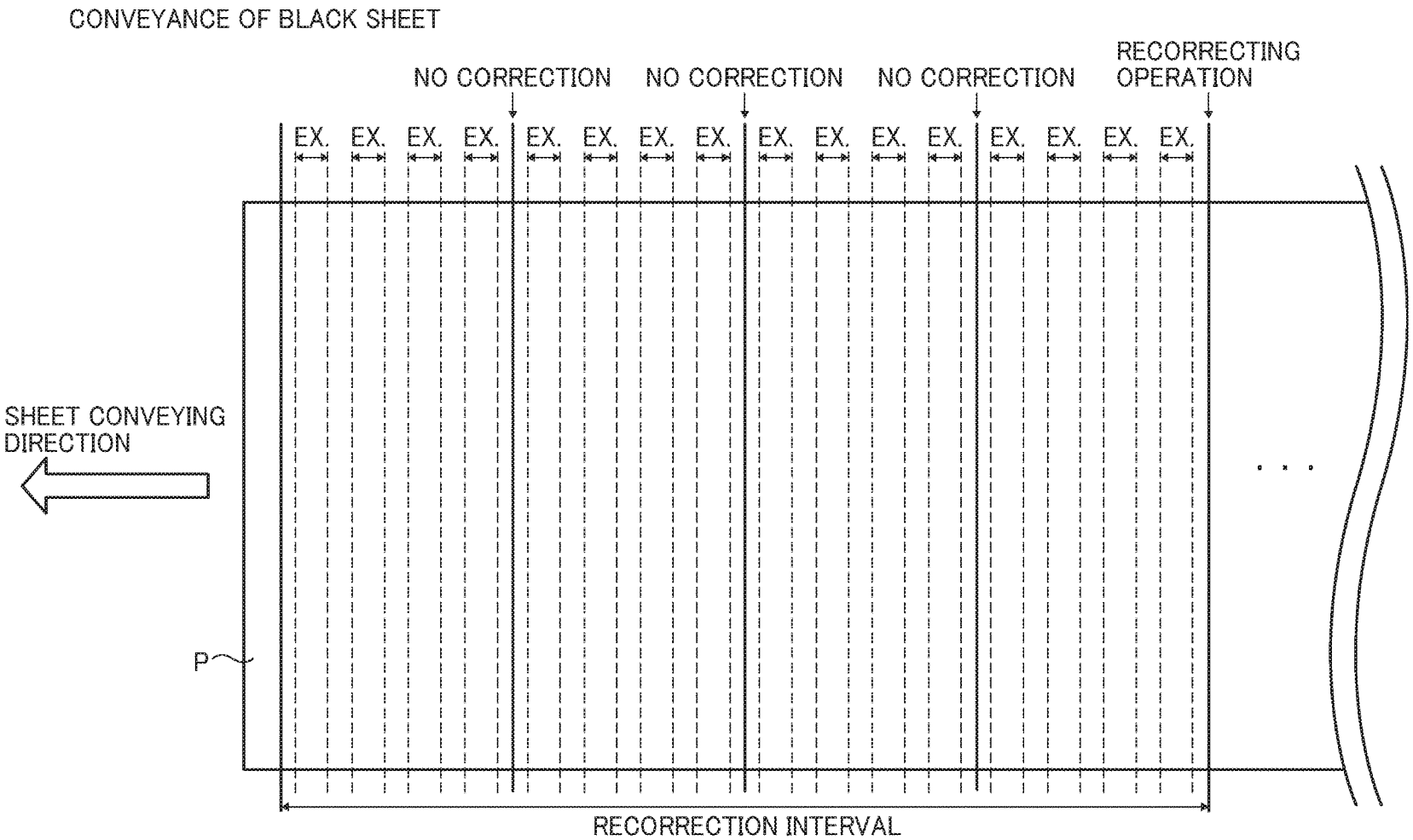

It is to be noted that FIGS. 16A, 16B and 16C are diagrams illustrating respective states in which the setting for the recorrecting operation is changed when the sheet P having different reflectance (color) is conveyed in the sheet conveying device according to Variation of this disclosure. As illustrated in FIGS. 16A, 16B and 16C according to Variation, the time interval for the recorrecting operation (the recorrection interval) alone may be changed according to the reflectance of the sheet P.

To be more specific, referring to FIG. 16A, in Variation, when the white sheet P (the reference color sheet) is conveyed (in the reference settings), the light emission time per light emission (EX.) of the second upstream side CIS 36 and the downstream side CIS 37 is set to be relatively short. Based on the detection results of the second upstream side CIS 36 and the downstream side CIS 37 detected at each relatively short time interval (the recorrection interval) corresponding to about four times the light emission time, the recorrection of the attitude of the sheet P is performed.

By contrast, referring to FIG. 16B, when a gray sheet P having reflectance smaller the white sheet P (the reference color sheet P) is conveyed, the light emission time per light emission (EX.) of the second upstream side CIS 36 and the downstream side CIS 37 is not changed from the reference settings. Then, based on the detection results of the second upstream side CIS 36 and the downstream side CIS 37 detected and acquired at each relatively long time interval (the recorrection interval) corresponding to about eight times the light emission time, the recorrection of the attitude of the sheet P is performed.

Further, referring to FIG. 16C, when a black sheet P having reflectance smaller the gray sheet P is conveyed, the light emission time per light emission (EX.) of the second upstream side CIS 36 and the downstream side CIS 37 is not changed from the reference settings. Then, based on the detection results of the second upstream side CIS 36 and the downstream side CIS 37 detected and acquired at each longer time interval (the recorrection interval) corresponding to about 16 times the light emission time, the recorrection of the attitude of the sheet P is performed.

Even when the above-described control is performed, the above-described configuration of Variation can achieve the substantially same effect as each configuration of the sheet conveying device 30 according to Embodiment 1.

As described above, similar to the sheet conveying device 30 according to Embodiment 1, the sheet conveying device 30 of the image forming apparatus 1 according to Embodiment 2 includes the first upstream side CIS 35, the second upstream side CIS 36 and the downstream side CIS 37 (the detectors) to optically detect the attitude of the sheet Pin the sheet conveyance passage, and the controller 90 to perform the recorrecting operations (the correcting operations) to correct the attitude of the pair of sheet holding rollers 31 by operating the second drive motor 62 (the rotation device) and the third drive motor 63 (the moving device) based on the detection results of the first upstream side CIS 35, the second upstream side CIS 36 and the downstream side CIS 37 at predetermined intervals while the pair of sheet holding rollers 31 the pair of rollers) is holding the sheet P. Consequently, the controller 90 performs the recorrecting operations (the correcting operations) according to the reflectance of the sheet P being conveyed, by setting at least one of light emission times of the first upstream side CIS 35, the second upstream side CIS 36 and the downstream side CIS 37, time intervals (recorrection intervals) for performing the recorrecting operations (the correcting operations), light emission intensity of the first upstream side CIS 35, the second upstream side CIS 36 and the downstream side CIS 37, and the conveying speed of the sheet P conveyed by the pair of sheet holding rollers 31.

According to this configuration, the sheet conveying device 30 corrects the attitude of the sheet P with high accuracy, regardless of reflectance of the sheet P being conveyed.

It is to be noted that, similar to Embodiment 1, this disclosure is applicable to the various configurations of Embodiment 2.

Embodiment 3

Figure 17:
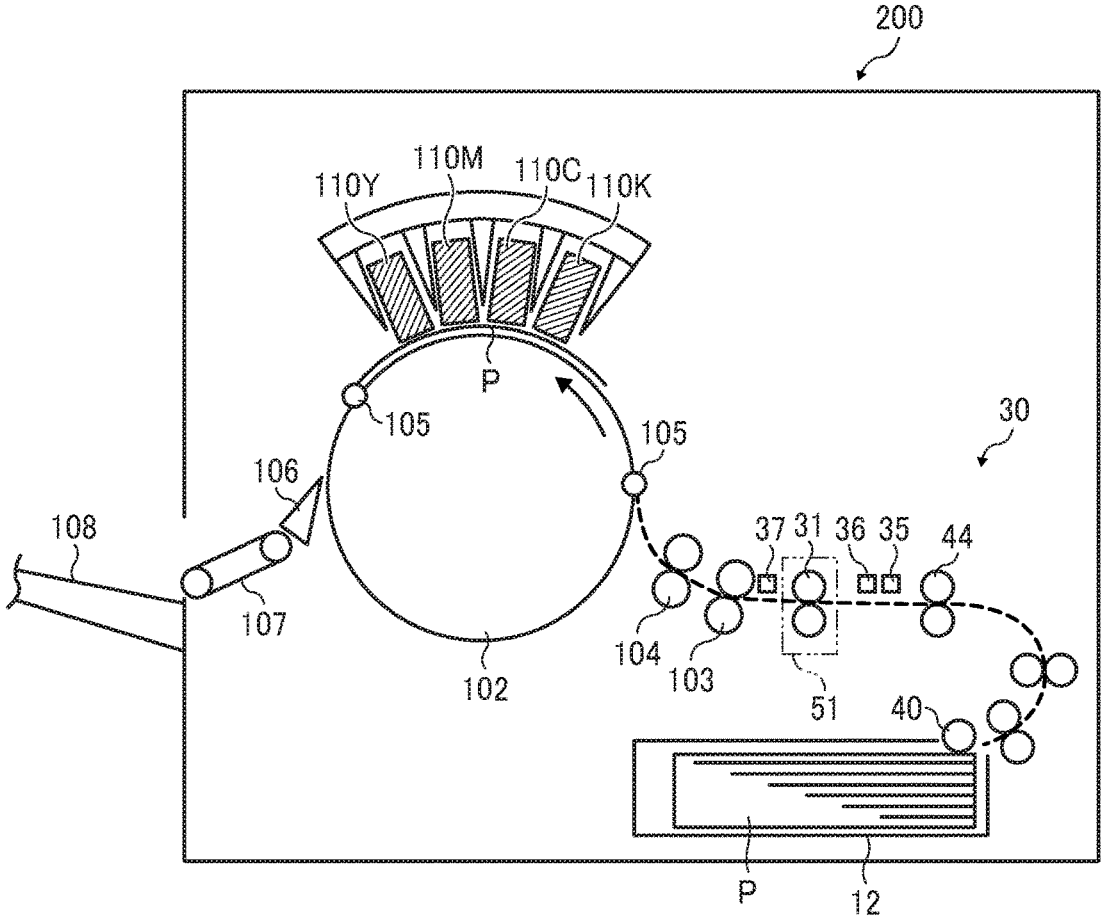
FIG. 17 is a diagram illustrating an overall configuration of an image forming apparatus according to Embodiment 3 of this disclosure.

Next, a description is given of a configuration and functions of the sheet conveying device 30 and an image forming apparatus 200, according to Embodiment 3 of this disclosure, with reference to FIG. 17.

FIG. 17 is a diagram illustrating an overall configuration of the image forming apparatus 200 according to Embodiment 3 of this disclosure. The configuration and functions of the image forming apparatus 200 illustrated in FIG. 17 according to Embodiment 3 is basically identical to the configuration and functions of the image forming apparatus 1 according to Embodiment 1, except that the image forming apparatus 200 according to Embodiment 3 is an inkjet printer while the image forming apparatus 1 according to Embodiment 1 is an electrophotographic image forming apparatus.

In FIG. 17, the image forming apparatus 200, that is, the inkjet printer, includes a conveyance drum 102, a pair of downstream side sheet conveying rollers 103, a pair of sheet conveying rollers 104, sheet grippers 105, a separating member 106, a conveying belt 107, a sheet discharging tray 108, and ink print heads 110Y, 110M, 110C and 110K, The conveyance drum 102 conveys the sheet P.

The pairs of downstream side sheet conveying rollers 103 is disposed downstream from the pair of sheet holding rollers 31 in the sheet conveying direction.

The pair of sheet conveying rollers 104 to convey the sheet P toward the conveyance drum 102.

Each of the sheet grippers 105 grips the sheet P on the conveyance drum 102.

The separating member 106 separates the sheet p from the conveyance drum 102.

The conveying belt 107 conveys the sheet P separated from the conveyance drum 102.

The sheet discharging tray 108 is a tray to which the sheet P is discharged and stacked after image formation and printing is completed.

Each of the ink print heads 110Y, 110M, 110C and 110K is a single head unit (i.e., a print module) including an image forming device to form and print an image with an inkjet method.

Similar to the electrophotographic image forming apparatus 1 according to Embodiment 1, the image forming apparatus 200 according to Embodiment 3 includes the sheet conveying device 30.

The image forming apparatus 200 according to Embodiment 3 is to form a color image and, as illustrated in FIG. 17, includes the ink print head 110K for black image and the ink print heads 110Y, 110M and 110C for yellow, magenta and cyan images, respectively. These four ink print heads 110Y, 110M, 110C and 110K are aligned to face the conveyance drum 102 along the rotation direction of the conveyance drum 102.

It is to be noted that the four ink print heads 110Y, 110M, 110C and 110K have the configuration identical to each other except for the ink colors (types). The ink print heads 110Y, 110M, 110C and 110K includes a piezoelectric actuator and a thermal actuator for a main part, nozzles used to discharge ink as liquid droplets, ink tanks filled with ink, a control board (e.g., the controller 90) and so forth.

Now, a description is given of operations performed by the image forming apparatus 200, with reference to FIG. 17.

First, as a print instruction is inputted together with image data from, for example, a personal computer to the controller 90 of the image forming apparatus 200, the sheet P is fed by the sheet feed roller 40 from the first sheet feed unit 12. The sheet P fed from the first sheet feed unit 12 is conveyed by the sheet conveying device 30 to the conveyance drum 102. At this time, similar to Embodiment 1, in the sheet conveying device 30 of Embodiment 3, the pair of sheet holding rollers 31 that functions as a pair of rollers performs the lateral and angular displacement corrections of the sheet P based on the detection results of the first upstream side CIS 35, the second upstream side CIS 36 and the downstream side CIS 37 (each functioning as a detector).

At the same time, the ink print heads 110Y, 110M, 110C and 110K convert and form image writing data based on the image data input to the controller 90.

Consequently, the sheet P conveyed to the conveyance drum 102 is positioned on the conveyance drum 102 while being gripped by the sheet grippers 105, and is conveyed in a counterclockwise direction along the rotation of the conveyance drum 102.

Then, based on the image writing data, ink as liquid droplets is sequentially sprayed from the ink print heads 110Y, 110M, 110C and 110K onto the sheet P conveyed in a direction indicated by arrow in FIG. 17 in response to the rotation of the conveyance drum 102. By so doing, a desired color image is formed on the sheet P.

Thereafter, the sheet P having the desired image thereon is separated from the conveyance drum 102 by the separating member 106. Then, the sheet P separated from the conveyance drum 102 is conveyed by the conveying belt 107 to be discharged to the sheet discharging tray 108.

As described above, similar to the sheet conveying device 30 according to Embodiments 1 and 2, the sheet conveying device 30 of the image forming apparatus 200 according to Embodiment 3 includes the first upstream side CIS 35, the second upstream side CIS 36 and the downstream side CIS 37 to optically detect the attitude of the sheet P in the sheet conveyance passage, and the controller 90 to perform the recorrecting operations (the correcting operations) to correct the attitude of the pair of sheet holding rollers 31 by operating the second drive motor 62 (the rotation device) and the third drive motor 63 (the moving device) based on the detection results of the first upstream side CIS 35, the second upstream side CIS 36 and the downstream side CIS 37 at predetermined intervals while the pair of sheet holding rollers 31 the pair of rollers) is holding the sheet P. Consequently, the controller 90 performs the recorrecting operations (the correcting operations) according to the reflectance of the sheet P being conveyed, by setting at least one of light emission times of the first upstream side CIS 35, the second upstream side CIS 36 and the downstream side CIS 37, time intervals (recorrection intervals) for performing the recorrecting operations (the correcting operations), light emission intensity of the first upstream side CIS 35, the second upstream side CIS 36 and the downstream side CIS 37, and the conveying speed of the sheet P conveyed by the pair of sheet holding rollers 31.

According to this configuration, the sheet conveying device 30 corrects the attitude of the sheet P with high accuracy, regardless of reflectance of the sheet P being conveyed.

It is to be noted that, similar to Embodiments 1 and 2, this disclosure is applicable to the various configurations of Embodiment 3.

Embodiment 4

Figure 18:
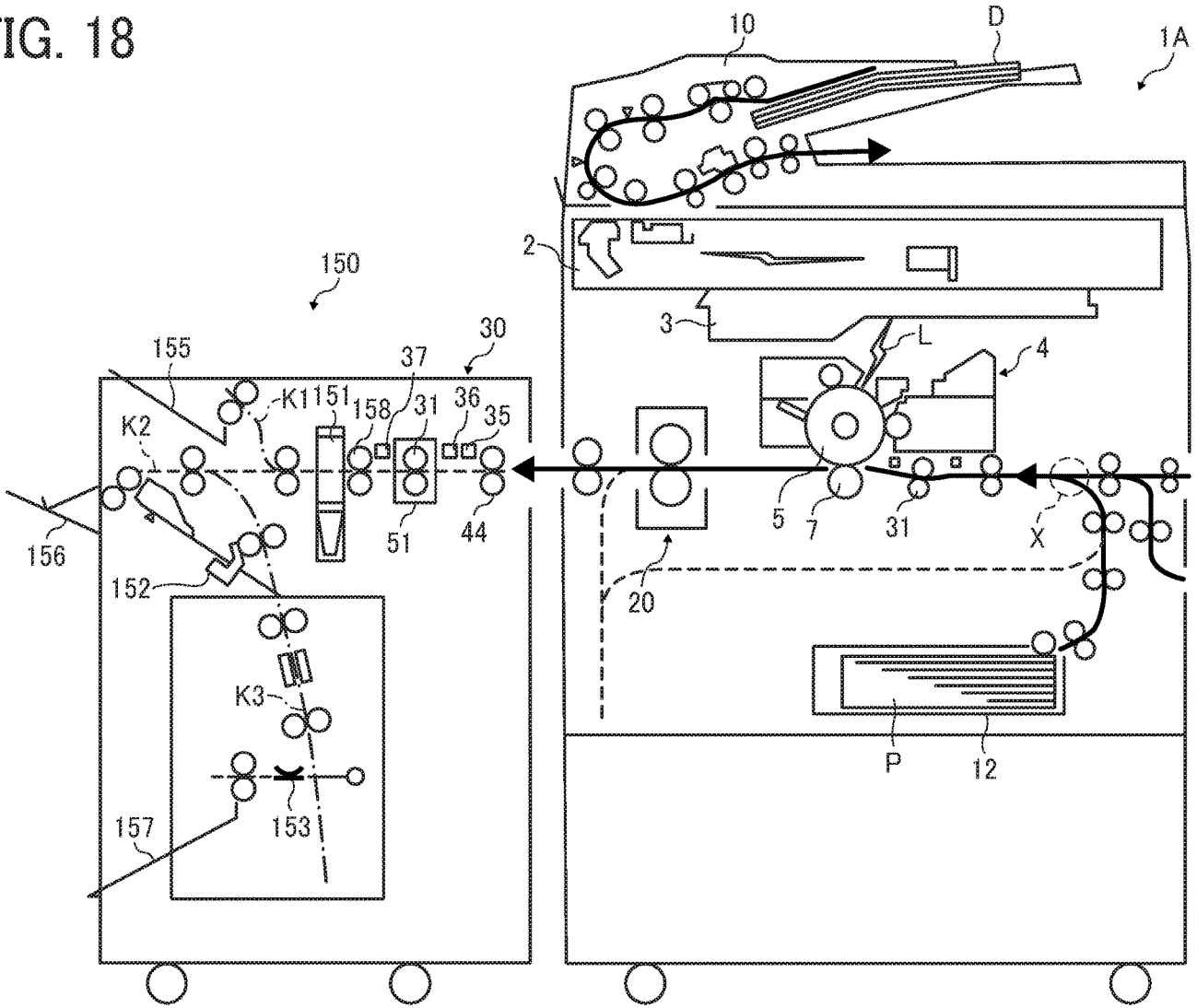
FIG. 18 is a diagram illustrating an overall configuration of an image forming apparatus according to Embodiment 4 of this disclosure.

Next, a description is given of a configuration and functions of the sheet conveying device 30 and an image forming apparatus 1A, according to Embodiment 4 of this disclosure, with reference to FIG. 18.

FIG. 18 is a diagram illustrating an overall configuration of the image forming apparatus 1A according to Embodiment 4 of this disclosure. The configuration and functions of the image forming apparatus 1A according to Embodiment 4 is basically identical to the configuration and functions of the image forming apparatus 1 according to Embodiment 1 and the image forming apparatus 200 according to Embodiment 3, except that the image forming apparatus 1A of Embodiment 4 includes a post processing device 150 that performs post processing operations such as punching, sheet binding and sheet folding, to the sheet P after completion of image formation.

The post processing device 150 illustrated in FIG. 18 is detachably attached to the apparatus body of the image forming apparatus 1A and includes a punching device 151, a binding device 152, a sheet folding device 153 and multiple trays (sheet stackers). The punching device 151 performs a punching process to punch or open holes on a sheet P. The binding device 152 performs a stapling process and a binding process of a sheet P. The sheet folding device 153 performs a folding process of a sheet P after image formation. The multiple trays (sheet stackers) of the post processing device 150 according to Embodiment 3 are a first discharging tray 155, a second sheet discharging tray 156 and a third sheet discharging tray 157. The post processing device 150 further includes a pair of downstream side sheet conveying rollers 158 disposed downstream from the pair of sheet holding rollers 31 in the sheet conveying direction.

Similar to the image forming apparatus 1 according to Embodiment 1 and the image forming apparatus 200 according to Embodiment 3, the post processing device 150 according to Embodiment 4 includes the sheet conveying device 30.

It is to be noted that the post processing device 150 further includes a first sheet conveyance passage K1, a second sheet conveyance passage K3 and a third sheet conveying passage K3. The first sheet conveyance passage K1 is a sheet conveyance passage to convey a sheet P to which the punching process is performed in the punching device 151 or a sheet P to which no post processing process is performed, to the first discharging tray 155.

The second sheet conveyance passage K2 is a sheet conveyance passage to convey a sheet P toward the binding device 152 and a bundle of sheets P after completion of the stapling process and/or the binding process to the second sheet discharging tray 156.

The third sheet conveyance passage K3 is a sheet conveyance passage to convey a sheet P toward the sheet folding device 153 and the sheet P after completion of the center folding process to the third sheet discharging tray 157.

Now, a description is given of image forming operations performed by the post processing device 150, with reference to FIG. 18.

First, after having been discharged from the apparatus body of the image forming apparatus 1A, the sheet P is convened into the post processing device 150. Then, similar to Embodiments 1 through 3, the pair of sheet holding rollers 31 included in the sheet conveying device 30 of Embodiment 4, performs the corrections of angular and lateral displacements of the sheet P based on the detection results of the first upstream side CIS 35, the second upstream side CIS 36 and the downstream side CIS 37. After the corrections of angular and lateral displacements, the sheet P is conveyed to any one of the first sheet conveying passage K1, the second sheet conveying passage K2 and the third sheet conveying passage K3 according to a post processing operation instructed by a user. After the corresponding post processing operation has been performed to the sheet P, the sheet P is discharged to any one of the first discharging tray 155, the second sheet discharging tray 156 and the third sheet discharging tray 157.

As described above, similar to the sheet conveying device 30 according to Embodiment 1 through Embodiment 3, the sheet conveying device 30 of the post processing device 150 according to Embodiment 4 includes the first upstream side CIS 35, the second upstream side CIS 36 and the downstream side CIS 37 to optically detect the attitude of the sheet P in the sheet conveyance passage, and the controller 90 to perform the recorrecting operations (the correcting operations) to correct the attitude of the pair of sheet holding rollers 31 by operating the second drive motor 62 (the rotation device) and the third drive motor 63 (the moving device) based on the detection results of the first upstream side CIS 35, the second upstream side CIS 36 and the downstream side CIS 37 at predetermined intervals while the pair of sheet holding rollers 31 is holding the sheet P. Consequently, the controller 90 performs the recorrecting operations (the correcting operations) according to the reflectance of the sheet P being conveyed, by setting at least one of light emission times of the first upstream side CIS 35, the second upstream side CIS 36 and the downstream side CIS 37, time intervals (recorrection intervals) for performing the recorrecting operations (the correcting operations), light emission intensity of the first upstream side CIS 35, the second upstream side CIS 36 and the downstream side CIS 37, and the conveying speed of the sheet P conveyed by the pair of sheet holding rollers 31.

According to this configuration, the sheet conveying device 30 corrects the attitude of the sheet P with high accuracy, regardless of reflectance of the sheet P being conveyed.

Specifically, the post processing device 150 in Embodiment 4 can reduce the amounts of angular and lateral displacements of the sheet P and provide the post processing operations with high accuracy.

It is to be noted that, similar to Embodiments 1 and 2, this disclosure is applicable to the various configurations of Embodiment 4.

It is to be noted that, in Embodiments 1 through 4, this disclosure is applied to the sheet conveying device 30 included in the electrophotographic image forming apparatus 1 and the inkjet image forming apparatus 200. However, the configuration is not limited thereto. For example, this disclosure can be also applied to a sheet conveying device included in any other image forming apparatus (for example, an offset printing machine) different from the electrophotographic image forming apparatus 1 and the inkjet image forming apparatus 200.

Further, even in the above-described case, the above-described configuration can achieve the same effect as each configuration of the sheet conveying device 30 according to Embodiments 1, 2, 3 and 4.

Further, in the above-described examples, this disclosure is applied to the sheet conveying device 30 employing the white paper as a reference color. However, this disclosure may also be applied to a sheet conveying devices employing any other color as a reference color.

Further, even in the above-described case, the above-described configuration can achieve the same effect as each configuration of the sheet conveying device 30 according to Embodiments 1, 2, 3 and 4.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set.

As described above, it is to be noted that the "width direction" is defined as a direction perpendicular to the sheet conveying direction of the sheet P.

It is to be noted that a "sheet" in the above-described embodiments of this disclosure is not limited to indicate a (regular) paper but also includes any other sheet-like material such as coated paper, label paper, OHP film sheet, film, metal sheet, prepreg, and the like, The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveying device comprising:

a pair of rollers configured to convey a sheet at a conveying speed in a sheet conveyance passage;

a detector configured to optically detect an attitude of the sheet in the sheet conveyance passage and obtain a detection result based upon the attitude optically detected;

a rotation device configured to rotate the pair of rollers in a direction parallel to a plane of the sheet; and a controller configured to perform a correcting operation to correct an attitude of the pair of rollers during a time interval, when the pair of rollers are contacting the sheet, by driving the rotation device based on the detection result obtained by the detector, the controller being configured to perform the correcting operation by setting, according to reflectance of the sheet, at least one of a light emission time of the detector, the time interval during which the correcting operation is performed, light emission intensity of the detector and the conveying speed of the sheet by the pair of rollers, wherein the sheet includes a first sheet having reflectance and a second sheet having reflectance relatively greater than the first sheet, and wherein the controller is configured to set the light emission time of the detector for the first sheet to be relatively longer than the light emission time of the detector for the second sheet.

2. The sheet conveying device according to claim 1, wherein the controller is configured to:

drive the rotation device, before the first or second sheet reaches the pair of rollers, to rotate the pair of rollers according to an angular displacement amount of the first or second sheet based on the detection result of the detector, from an angular home position to a position opposing to the first or second sheet, and drive the rotation device to rotate the pair of rollers, when contacting the first or second sheet, to the angular home position by an angular displacement correction amount of first or second the sheet.

3. The sheet conveying device according to claim 2, wherein the controller is configured to:

drive the rotation device to rotate the pair of rollers to the angular home position when contacting the first or second sheet; and repeat the correcting operation as a recorrecting operation.

4. The sheet conveying device according to claim 1, further comprising a moving device configured to move the pair of rollers in a width direction, wherein the controller is configured to perform the correcting operation by driving the rotation device and the moving device, based on the detection result of the detector at the time interval, when the pair of rollers is conveying the first or second sheet.

5. The sheet conveying device according to claim 1, wherein the controller is configured to set the conveying speed of the first sheet to be relatively slower than the conveying speed of the second sheet.

6. The sheet conveying device according to claim 1, wherein the detector comprises:

a first detector disposed upstream from the pair of rollers in a sheet conveying direction and configured to optically detect the attitude of the first or second sheet; and a second detector disposed downstream from the pair of rollers in the sheet conveying direction and configured to optically detect the attitude of the first or second sheet.

7. The sheet conveying device according to claim 1, further comprising:

a pair of downstream side sheet conveying rollers, disposed downstream from the pair of rollers in the sheet conveying direction, configured to contact and convey the first or second sheet while the first or second sheet is being contacted and conveyed by the pair of rollers, wherein the controller is configured to repeat the correcting operation until immediately before the first or second sheet, after the controller performs the correcting operation, reaches the pair of downstream side sheet conveying rollers.

8. The sheet conveying device according to claim 1, wherein the detector is configured to detect the reflectance of the first or second sheet and produce a reflectance detection result, and wherein the controller is configured to change a setting for the correcting operation based on the reflectance detection result of the detector.

9. The sheet conveying device according to claim 1, wherein the reflectance of the first or second sheet is detected based on information input via a control panel and a detection result of the information is produced, and wherein the controller is configured to change a setting for the correcting operation based on the detection result of the information produced.

10. The sheet conveying device according to claim 1, wherein the controller is configured to change a setting in the correcting operation at a time when a regular conveying process is not performed.

11. An image forming apparatus comprising the sheet conveying device according to claim 1.

12. A sheet conveying device comprising:

a pair of rollers configured to convey a sheet at a conveying speed in a sheet conveyance passage;

a detector configured to optically detect an attitude of the sheet in the sheet conveyance passage and obtain a detection result based upon the attitude optically detected;

a rotation device configured to rotate the pair of rollers in a direction parallel to a plane of the sheet; and a controller configured to perform a correcting operation to correct an attitude of the pair of rollers during a time interval, when the pair of rollers are contacting the sheet, by driving the rotation device based on the detection result obtained by the detector, the controller being configured to perform the correcting operation by setting, according to reflectance of the sheet, at least one of a light emission time of the detector, the time interval during which the correcting operation is performed, light emission intensity of the detector and the conveying speed of the sheet by the pair of rollers, wherein the sheet includes a first sheet having reflectance and a second sheet having reflectance relatively greater than the first sheet, and wherein the controller is configured to set the time interval during which the correcting operation is performed of the first sheet to be relatively longer than the time interval during which the correcting operation is performed for the second sheet.

13. A sheet conveying device comprising:

a pair of rollers configured to convey a sheet in a sheet conveyance passage;

a detector configured to optically detect an attitude of the sheet in the sheet conveyance passage and obtain a detection result based upon the attitude optically detected;

a moving device configured to move the pair of rollers in a width direction; and a controller configured to perform a correcting operation to correct an attitude of the pair of rollers during a time interval, when the pair of rollers are contacting the sheet, by driving the moving device based on the detection result obtained by the detector, the controller being configured to perform the correcting operation by setting, according to reflectance of the sheet, at least one of a light emission time of the detector, the time interval during which the correcting operation is performed, light emission intensity of the detector and the conveying speed of the sheet by the pair of rollers, wherein the sheet includes a first sheet having reflectance and a second sheet having reflectance relatively greater than the first sheet, and wherein the controller is configured to set the light emission time of the detector for the first sheet to be relatively longer than the light emission time of the detector for the second sheet.

14. The sheet conveying device according to claim 13, wherein the controller is configured to:

drive the moving device, before the first or second sheet reaches the pair of rollers, to move the pair of rollers in the width direction, from a lateral home position according to a lateral displacement amount of the first or second sheet detected by the detector, and drive the moving device to move the pair of rollers while contacting the first or second sheet to the lateral home position by a lateral displacement correction amount of the first or second sheet, a lateral correction amount being at least part of the detection result.

15. The sheet conveying device according to claim 14, wherein the controller is configured to:

drive the moving device to move the pair of rollers to the lateral home position while contacting the first or second sheet; and repeat the correcting operation as a recorrecting operation.

16. The sheet conveying device according to claim 13, further comprising:

a rotation device configured to rotate the pair of rollers in a direction parallel to a plane of the first or second sheet, wherein the controller is configured to perform the correcting operation by driving the moving device and the rotation device, based on the detection result of the detector, when the pair of rollers is conveying the first of second sheet.

17. An image forming apparatus comprising the sheet conveying device according to claim 13.

18. A sheet conveying device, comprising:

a pair of rollers configured to convey a sheet in a sheet conveyance passage;

a detector configured to optically detect an attitude of the sheet in the sheet conveyance passage and obtain a detection result based upon the attitude optically detected;

a moving device configured to move the pair of rollers in a width direction; and a controller configured to perform a correcting operation to correct an attitude of the pair of rollers during a time interval, when the pair of rollers are contacting the sheet, by driving the moving device based on the detection result obtained by the detector, the controller being configured to perform the correcting operation by setting, according to reflectance of the sheet, at least one of a light emission time of the detector, the time interval during which the correcting operation is performed, light emission intensity of the detector and the conveying speed of the sheet by the pair of rollers, wherein the sheet includes a first sheet having reflectance and a second sheet having reflectance relatively greater than the first sheet, and wherein the controller is configured to set the time interval during which the correcting operation is performed of the first sheet to be relatively longer than the time interval during which the correcting operation is performed for the second sheet.

* * * * *